US005614993A

United States Patent [19]

Smith et al.

[11] Patent Number: 5,614,993

[45] Date of Patent: Mar. 25, 1997

[54] SYSTEM AND METHOD FOR JOB SET UP SUMMARIZING IN REPROGRAPHIC APPARATUS

[75] Inventors: Barbara S. Smith, Fairport; Frederick E. Altrieth, III, Scottsville; Douglas B. Beaudet, Brockport, all of N.Y.

[73] Assignee: Eastman Kodak Company, Rochester, N.Y.

[21] Appl. No.: 398,231

[22] Filed: Mar. 3, 1995

[51] Int. Cl.[6] ..... G03G 21/00

[52] U.S. Cl. ..... 399/81; 345/173; 395/326

[58] Field of Search ..... 355/200, 202, 355/204, 209; 345/173; 395/113, 155

[56] References Cited

U.S. PATENT DOCUMENTS

| | | | |
|---|---|---|---|
| 4,952,988 | 8/1990 | Furuichi et al. | 355/209 |
| 4,970,549 | 11/1990 | Yoshizuka et al. | 355/209 |
| 5,045,880 | 9/1991 | Evanitsky et al. | 355/200 |
| 5,049,929 | 9/1991 | Anderson et al. | 355/204 |
| 5,049,931 | 9/1991 | Knodt | 355/209 |
| 5,105,220 | 4/1992 | Knodt et al. | 355/209 |
| 5,109,252 | 4/1992 | Schott | 355/202 |
| 5,113,222 | 5/1992 | Wilson et al. | 355/209 |
| 5,185,628 | 2/1993 | Wilson et al. | 355/209 |
| 5,463,448 | 10/1995 | Wilson et al. | 355/209 X |
| 5,467,170 | 11/1995 | Wilson et al. | 355/209 |
| 5,500,717 | 3/1996 | Altrieth | 355/209 |

*Primary Examiner*—Fred L. Braun
*Attorney, Agent, or Firm*—Lawrence P. Kessler

[57] ABSTRACT

An improved summarization system for reproduction apparatus of the kind having a plurality of operating features for producing copy jobs. The apparatus includes an operator control communication interface, a display device for producing feature selection screens and signals indicative of selected features and a memory and control for addressing screens to the display device and controlling the apparatus to produce copies. The summarization system is operatively associated with the memory and control for generating and addressing onto the display device, separate screens summarizing, respectively, selected standard operating features, selected job level operating features, and selected page level operating features, without display of non-selected operating features.

21 Claims, 33 Drawing Sheets

SYSTEM AND METHOD FOR JOB SET UP SUMMARIZING IN REPROGRAPHIC APPARATUS

FIELD OF THE INVENTION

The present invention relates to operator control and communication interfacing in reproduction apparatus such as electrostatographic copiers or printers, and more particularly to improved systems and methods for conveying to operators of such apparatus, a summarized job setup status.

BACKGROUND OF INVENTION

High speed electrostatographic copies and printers are extremely versatile and complex machines. They usually include interfaced accessories such as document input feeders, copy output sorters and staplers, and can have alternate document and copy sheet feet paths to handle input of 1-sided (simplex) and 2-sided (duplex) originals, and output 1 and 2-sided copies. The outputs can have various deliver locations and be finished (e.g., stapled or bound) in various formats. The output copies can be selected to have different sizes and the images formed thereon can be selectively varied in a large number of ways, e.g., as to copy density, magnification, color, image reversal, image position, image screening image erasing, etc.

To operate such an apparatus to perform a copying job, the user must make a large number of decisions about how these apparatus operating features will be set to perform that particular job, or default to nominal settings. Moreover, certain operating features of the apparatus can be used selectively on all or only certain ones of the pages of an output copy, e.g., to provide color on only certain pages, but margin erase on all pages.

It can be appreciated from the foregoing that job setup for high speed reprographic apparatus can be complex work that even skilled operators find time consuming and challenging. The jobs often involve producing many copy output sets and errors in job setup can be costly. To ease this situation, various touch-selection screen display devices have been developed to show apparatus mode and operating feature selection options in sequential screen displays, along with prompting instruction screens (see e.g., U.S. Pat. No. 5,049,531). As a further improvement for easing operator setup, the communication/control interface system described in U.S. Pat. No. 5,113,222 separates the operator selection process, presented on the display screens of a reproduction apparatus control system, into three selection levels, a standard feature level, a special features-job level and a special features-page level. Within each selection level a series of screens can be sequentially addressed onto the display device to assist the operator in selections of operating features available at that level. An indica (e.g., a solid box) can be provided next to a selection(s) on the different level options screens to indicate an operating feature has been selected at that level. U.S. Pat. No. 4,970,549 discloses a display device that is addressable with a number of different operating feature selection screens, e.g., magnification, erase, simplex-duplex, and provides a written message on such selection screens, informing the operator what has been selected.

The process for selecting modes and operating features is improved by techniques such as described in the prior art above; however, it is still quite a burdensome task for the operator to keep track of all of the selections made, e.g., to confirm setup correctness before starting to copy, or to assure compatibility of feature selections at various stages of the selection procedure. Also, it would be highly useful in systems that store job setups for reruns, to be able to quickly and easily confirm that the large number of saved operating features selections are the desired ones.

SUMMARY OF INVENTION

One significant objective of the present invention is to provide for complex reproduction apparatus such as described above, improved systems and methods for summarizing to the operator, the status of operating modes and features selected for a particular copy job setup. Another important purpose of the present invention is to provide for the operator, simplified setup summary information, that is more readily available and more easily noted and understood by the operator. One very important feature of the present invention is the division of the summary information into different displays so that the information is less cluttered, and more readily perceived by the operator. Another advantageous feature of the invention is the provision of concise selected feature summaries on the different group displays, without the clutter and distraction of non selected feature information. Another important feature of the invention provides the grouping of summary information on a related context basis, e.g., standard level features selections, job level features selections and page level features selections, so that unique navigation systems can more directly access the operator to summary information that is needed at particular stages of the job setup process. For example, when working on job level setups, a job level summary is directly available. Many further advantages will become apparent during the subsequent detailed description of the invention.

Thus, in one aspect, the present invention constitutes an improved summarization system for reproduction apparatus of the kind having a plurality of operating features for producing copy jobs, an operator control communication interface including display means providing screens for operating feature selections and memory and control means for storing signals sets representing selected operating features and for controlling the reproduction apparatus to produce copy jobs in accord with such selections signals. The improved summarization system includes means, operatively associated with the reproduction apparatus memory and control means, for generating and addressing said display means with separate display screens summarizing, respectively, different operating features selections.

In another aspect the present invention constitutes in such reprographic apparatus an improved method for summarizing user selected operating features. The method includes the steps of: (i) displaying an overview summarization screen comprising selected standard operating features, without non-selected standard operating features and (ii) displaying a job level summary screen comprising selected job level operating features, without non-selected job level operating features.

BRIEF DESCRIPTION OF DRAWINGS

The subsequent description of preferred embodiments of the invention refers to the accompanying drawings wherein.

DETAILED DESCRIPTION OF THE INVENTION

Figure 1:
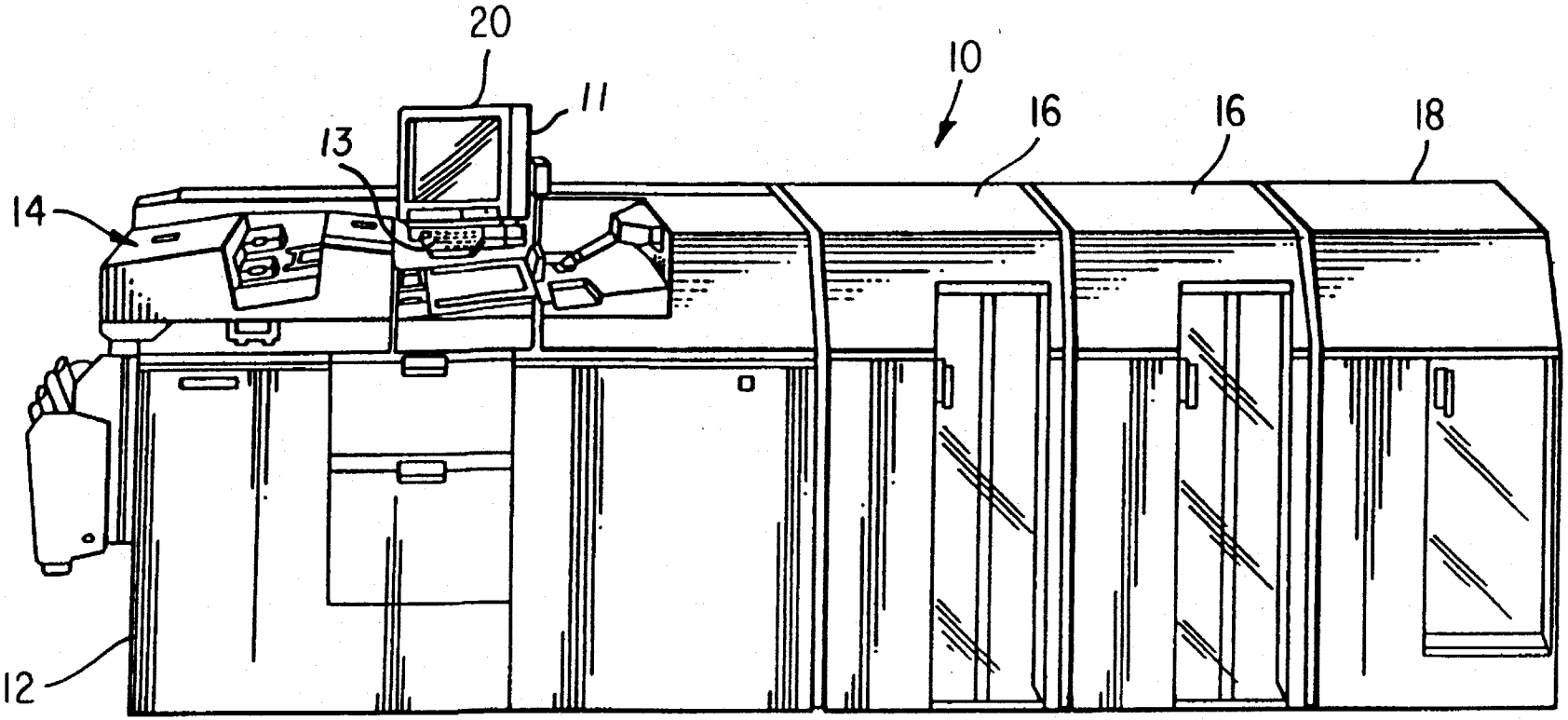
FIG. 1 is a perspective view of a reproduction apparatus which can incorporate the present invention.

Referring now to the accompanying drawings, FIG. 1 shows a typical reproduction apparatus, designated generally by the numeral 10, including an operator control communication interface 20 having a display device 11 and a display control panel 13. The exemplary reproduction apparatus 10 has a marking engine 12 for producing copies, e.g., such as original documents circulated by a document feeder 14. Several well known finishing accessories, such as sorters 16 and stacker/stapler 18, are associated with marking engine 12. Of course, other well known marking engines and associated accessories, serving in various configurations as copiers or printers, can usefully incorporate the present invention.

Figure 2:
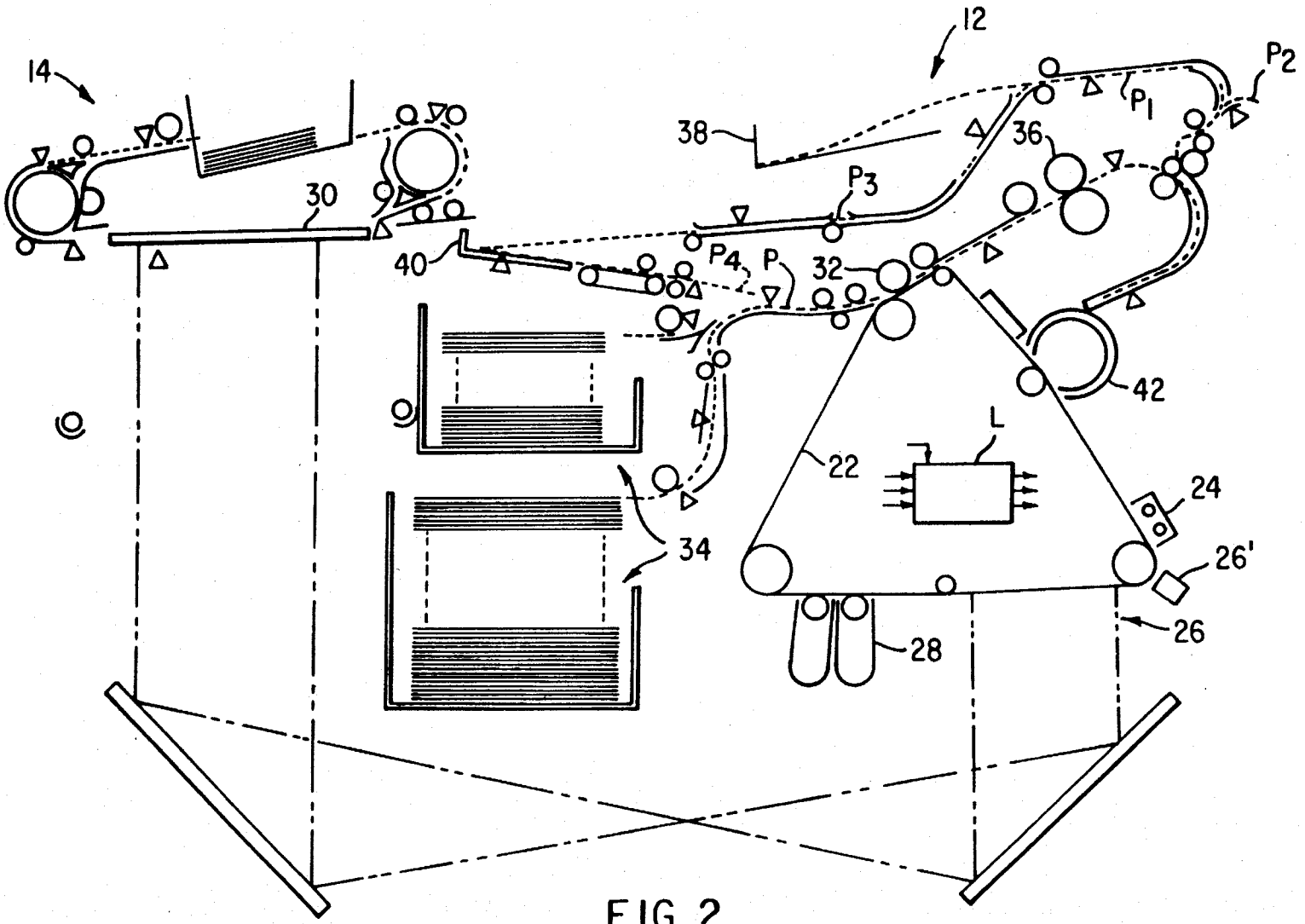
FIG. 2 is a schematic view illustrating some of the operating features and modes of the FIG. 1 apparatus.

As shown in FIG. 2, the marking engine 12 has a dielectric support 22, in the form of an endless web, supported for movement about an endless path. In the reproduction cycle, the moving dielectric support 22 is uniformly charged as it moves past a primary charging station 24. Thereafter, the uniformly charged dielectric support passes through an exposure station 26 where the uniform charge is altered to form a latent image charge pattern corresponding to information desired to be reproduced. Depending upon the characteristics of the dielectric support and the overall reproduction system, formation of the latent image charge pattern may be accomplished by exposing the dielectric support 22 to a reflected light image of an original document to be reproduced delivered to a transparent platen 30 by the document feeder 14. Alternatively, formation of the latent image charge pattern may be accomplished by "writing" on the dielectric support with a series of lamps 26' (e.g., LED's or lasers) or point electrodes activated by electronically generated signals based on desired information to be reproduced.

The latent image charge pattern on the dielectric support 22 is then brought into association with a development station 28 which applies pigmented marking particles to adhere to the dielectric support to develop the latent image. The portion of the dielectric support 22 carrying the developed image then passes through a transfer station 32 in register with a receiver member fed in proper timed relation from a supply hopper 34 along the path P. An electric field produced in the transfer station 32 attracts the marking particles of the developed image from the dielectric support to the receiver member.

The electric transfer field may also cause the receiver member to adhere to the dielectric support 22. Accordingly, a detack mechanism (not shown), immediately downstream in the direction of travel of the dielectric support, is provided to facilitate removal of the receiver member from the dielectric support. The detack mechanism may be, for example, an AC corona charger for neutralizing the attractive field holding the receiver member to the dielectric support. After the developed image is transferred to the receiver member and the receiver member is separated from the dielectric support, the receiver member is transported through a fusing device 36 where the image is fixed to the receiver member by heat and/or pressure, for example.

The receiver member beating the fixed image is then selectively delivered to an appropriate desired output. The output may be directed along path P1 to a top exit hopper 38 for direct operator retrieval, or along path P2 through a side exit for delivery to one of the output accessories 16, 18. Alternatively, the output may be directed along the path P3 to an intermediate hopper 40, where it is effectively turned over and delivered along the path P4 to return to the transfer station 32 to enable a duplex reproduction to be formed on such receiver member. Simultaneously, with delivery to the desired output, the dielectric support 22 is cleaned of any residual marking particles at cleaning station 42 and returned to the primary charging station 24 for reuse.

In the exemplary arrangement for the reproduction apparatus 10 (or any other suitable arrangement), it is apparent that many different modes of user selectable operations or functions are possible. For example, duplex document booklets may be formed from simplex or duplex original information, or information to be copied may be edited to change its size, content, or orientation. Further, the typical reproduction apparatus 10 has the ability to communicate to the user its status with regard to operating conditions or supply status, for example.

Figure 3:
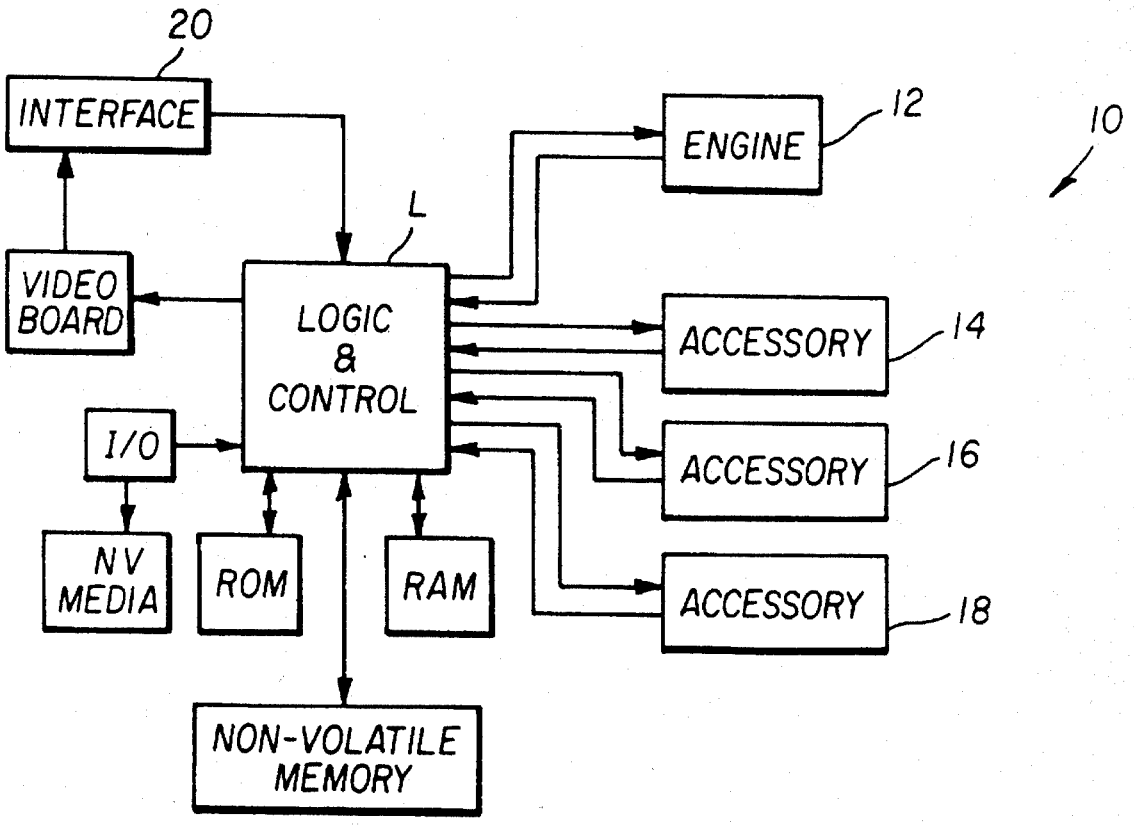
FIG. 3 is a block diagram of the memory and control system of the FIG. 1 apparatus.

The operator control communication interface 20 includes, for example, a display device 11 having a touch activated screen with a manually activated hard key panel 13. The operator control interface 20 is electrically coupled in any well known manner to a logic and control unit L located, for example, within the housing of the reproduction apparatus 10. The logic and control unit L, as schematically shown in FIG. 3, includes a microprocessor based controller electrically coupled to the marking engine and accessories of the reproduction apparatus 10. The controller includes random access memory (RAM), read only memory (ROM), and non-volatile memory. The controller may also include a reader/writer to non-volatile media, such as a disk. Of course, the operator control interface 20 may alternatively include a stand-alone logic and control unit which would then, in turn, be electrically coupled to the logic and control unit L of the reproduction apparatus 10.

In order to control the reproduction apparatus 10, the controller of the logic and control unit L receives input signals from the operator control communication interface 20 and a plurality of sensors associated in any well known manner with the reproduction apparatus marking engine 12 and accessories 14, 16, and 18. Based on such signals and a program for the microprocessor, the logic and control unit produces appropriate signals to control the various operating devices within the reproduction apparatus. The production of a program for a number of commercially available microprocessors is a conventional skill well understood in the art and does not form a part of this invention. The particular details of any such program would, of course, depend upon the architecture of the designated microprocessor.

Figure 4:
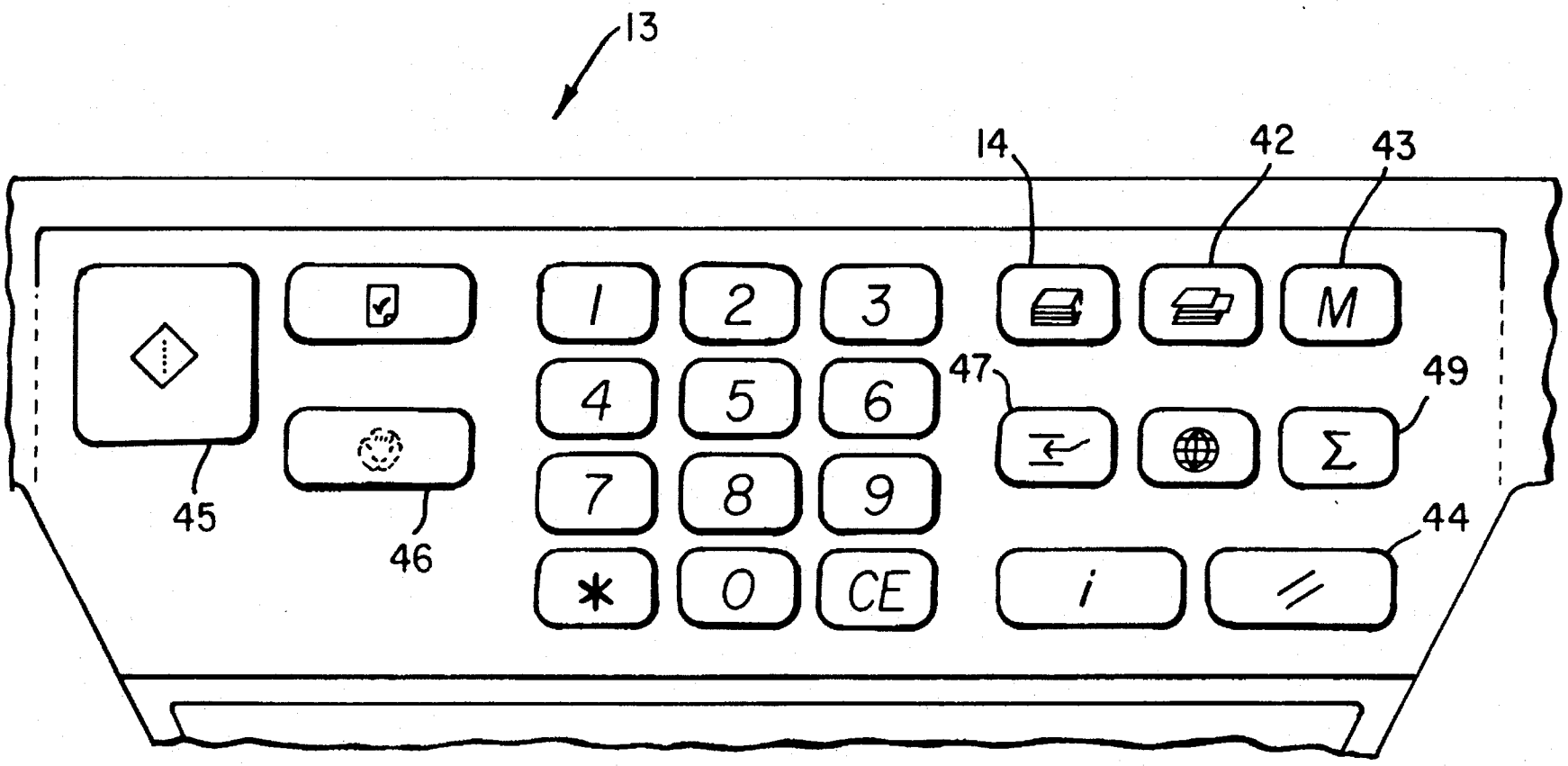
FIG. 4 is an enlarged plan view of a hard key display control panel of the FIG. 1 apparatus.

The present invention provides improved structures and modes for the FIG. 1 reproduction apparatus to provide operating features s selections summarizations of complex reproduction job(s), which in this context will comprise a large number of operating features selections from the vast menu available with the apparatus 10. One preferred combination for use in accord with the invention comprises the hard key panel 13 and touch screen display device 11, shown e.g., in FIGS. 1 and 4, as operable under the control of logic and control system L, with its associated memories and microprocessor. Thus, the hard keyboard 13 can comprise, among other mode selection keys, a job level selection mode key 41, a page level selection mode key 42, a memory selection mode key 43, a reset key 44 and a summary request key 49. Other mode selection keys such as start 45, stop 46, interrupt 47, etc., are provided, but not involved directly with the description of the present invention.

Figure 5:
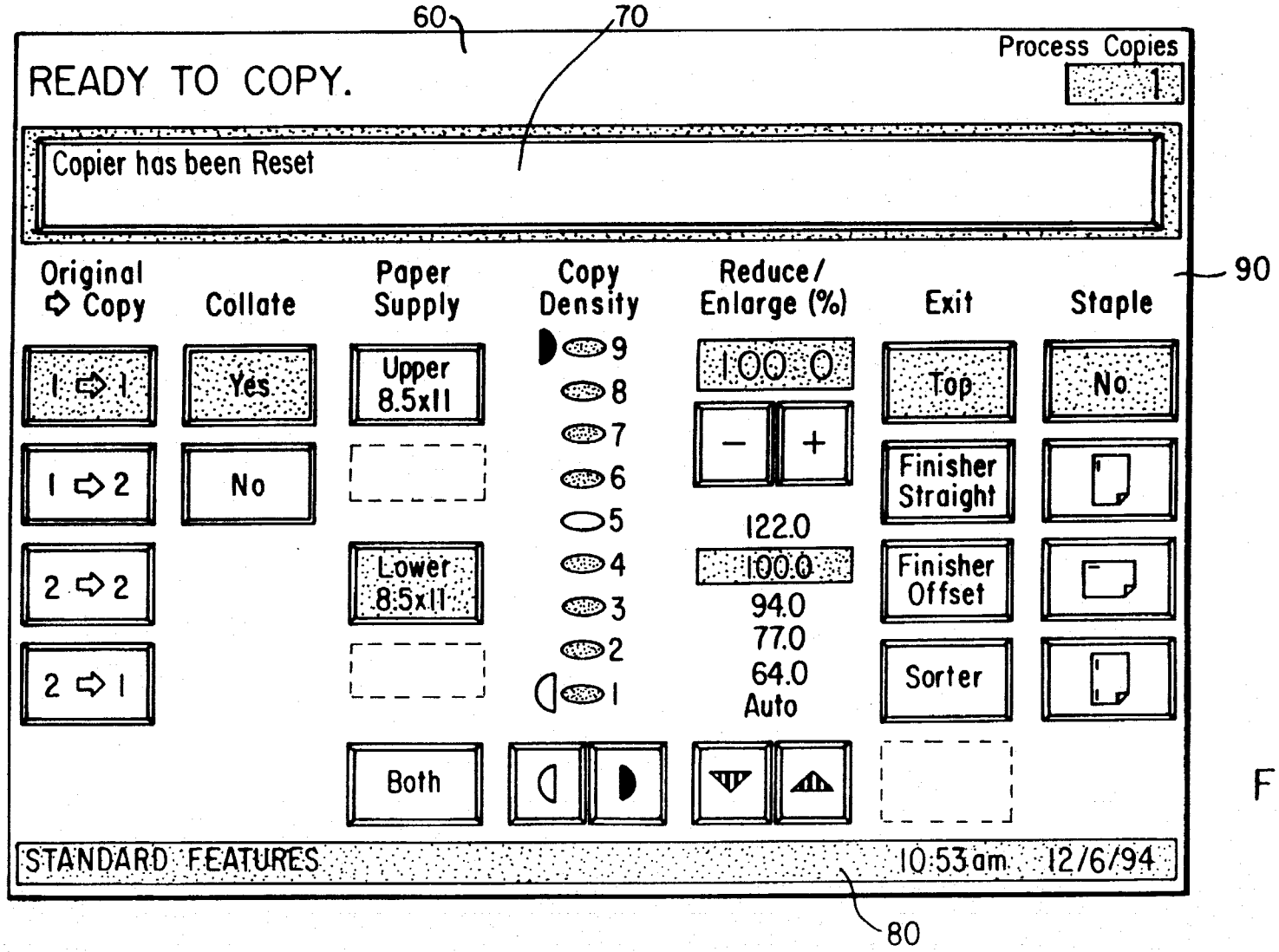
FIG. 5 is a front view of the inter-active display device of the FIG. 1 apparatus showing a standard operating features selection screen as it might be presented to a user with nominal feature selections actuated.
Figure 6:
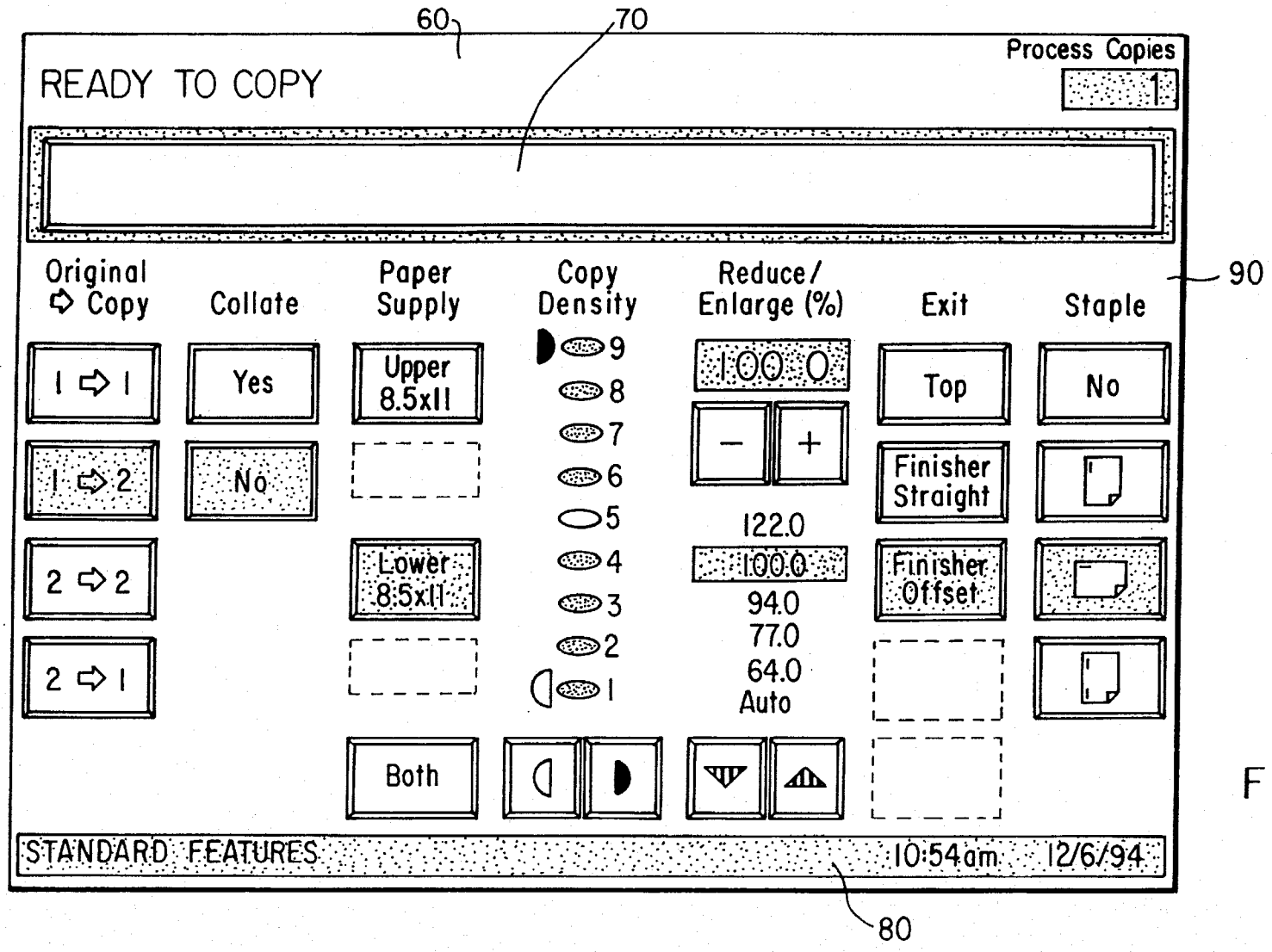
FIG. 6 is a front view similar to FIG. 5 but showing different operating features selected.

FIG. 5 shows a standard features screen that is addressed onto display device 20 from memory of the logic unit L in response to the operator pushing the reset key 44 of panel 13 to initiate a new job setup. In general, the selection screen includes a top banner section 60, a message section 70, a lower banner section 80 and a main display field of 90. Section 60 conveys information relative to the general reproduction apparatus status and section 80 conveys the genetic name for the information within the main display field 90. Section 70 is available for other operator information or directions. The screens will highlight selected features and FIG. 5 shows simplex to simplex copy mode, collated, using the lower paper supply (with 8½x11 inch paper), an avenge copy density (5), 100% magnification, copies delivered to the top exit hopper, without staples, which are typical nominal selections presented to the operator at the commencement of job setup selections. The operator's task is to accept or change these selections as well as to make other selections from subsequent screens called to address upon display device 20. For example, FIG. 6 shows the standard features screen as it would exist when the operator had exercised selection (by touch of designated screen regions) for: (i) "simplex original to duplex output", (ii) no collation of the output copy sheets (iii) the copy output should go to the finisher exit and (iv) landscape stapling.

Figure 7:
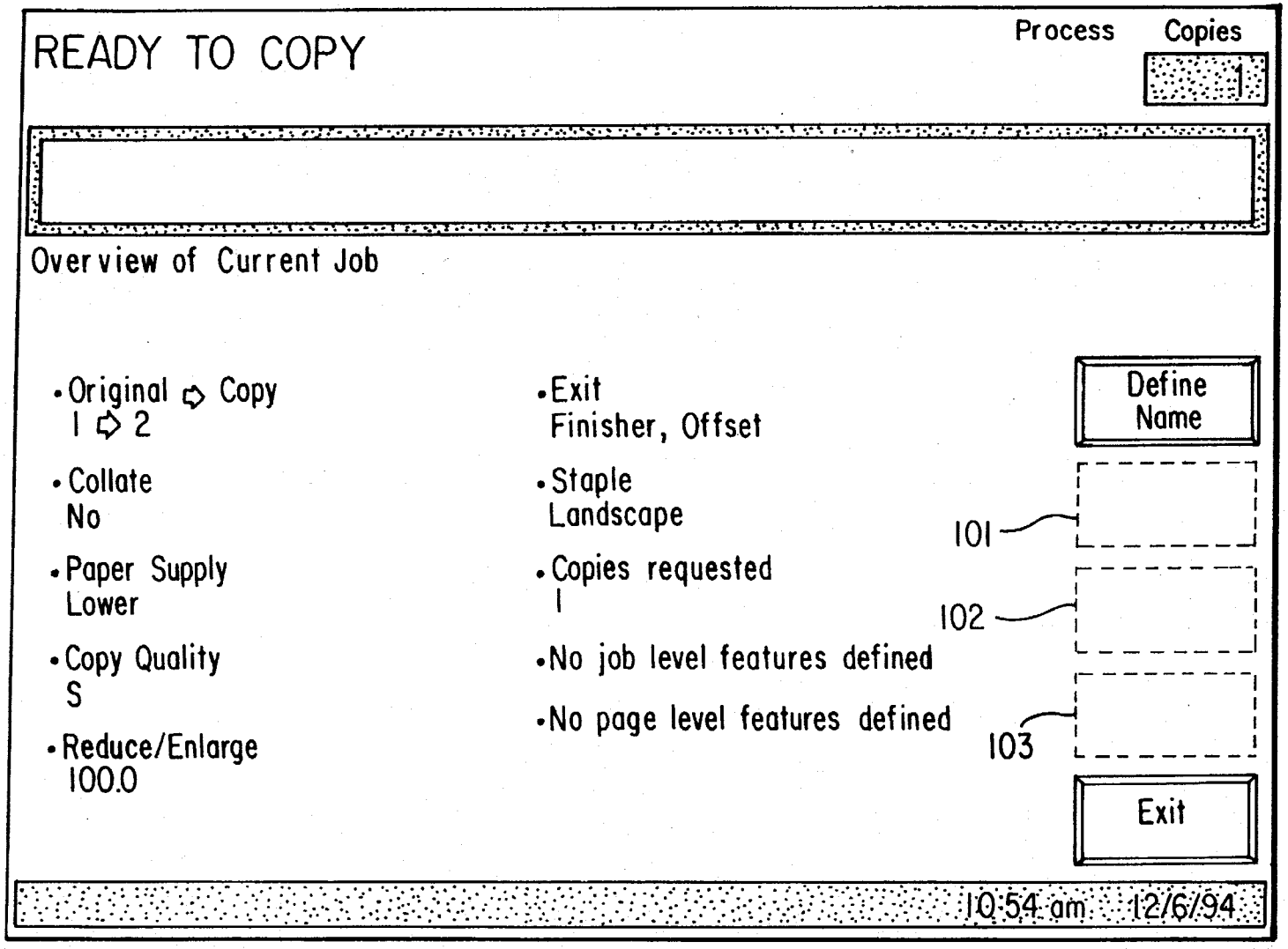
FIG. 7 is a front view of the active display device of FIG. 1 showing a overview summary screen, according to the present invention, summarizing the FIG. 6 operating feature selections.

At this stage, signals representing the standard operating features chosen for the copy job are transmitted to memory (e.g., RAM) of the logic unit L, from a detection of the state of touch screen shown in FIG. 6 (i.e., with some nominal operating features still remaining as selections and with some having been changed to other operating feature selections as noted above). In response to an actuation of the start key 45, copying would commence under the control of logic unit L to produce the requested numbers of copy sets (1) using the selected operating features stored in the memory of logic unit L. However, if instead the operator desires to check the entire machine setup before commencing to copy, the summary key 49 on panel 13 is actuated and the overview summary screen shown in FIG. 7 is addressed onto the display device 11 by logic unit L. The overview summary screen comprises a listing of selected standard operating features, without any non-selected operating features and an abbreviated list of selected job and page level operating features (to be described subsequently).

Figure 17:
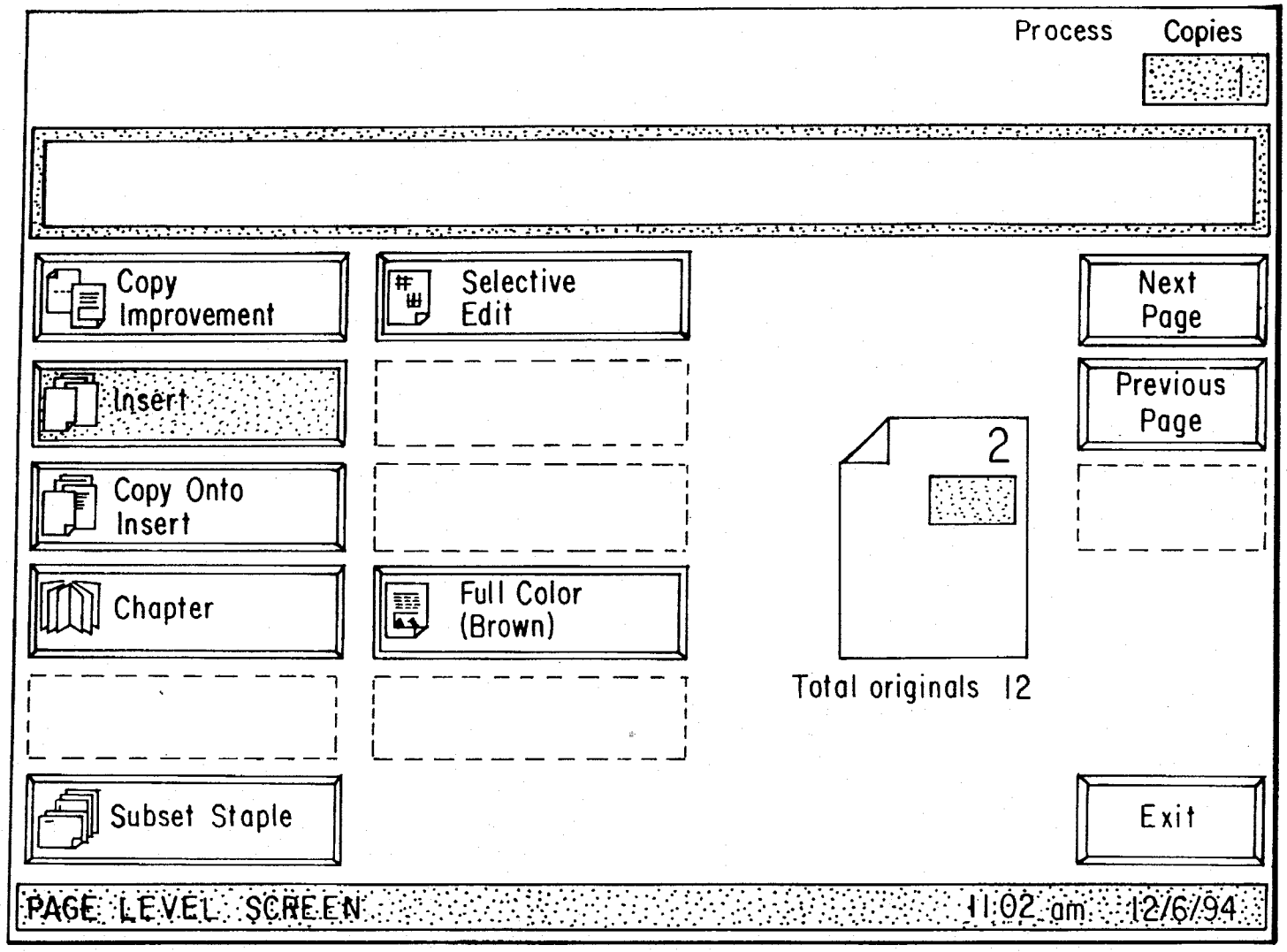
FIGS. 17–19 show page level operating features selection screens addressed onto the display device.

Thus, in accord with the present invention the operating features selections for the apparatus are conveniently divided into three basic categories: standard features selections (such as paper supply selection, magnification reduction, exit, etc.,—see FIG. 5); job level features selections (such as edge erase, image shift, etc.,—see FIG. 9); and page level features selections (such as subset staple, color, insert, pause, etc.,—see FIG. 17). The summary system is similarly divided into three separate screen address subsystems: the standard feature/overview selection summary screen, the job level feature selection summary screen and the page level feature selection summary screen(s).

Figure 8:
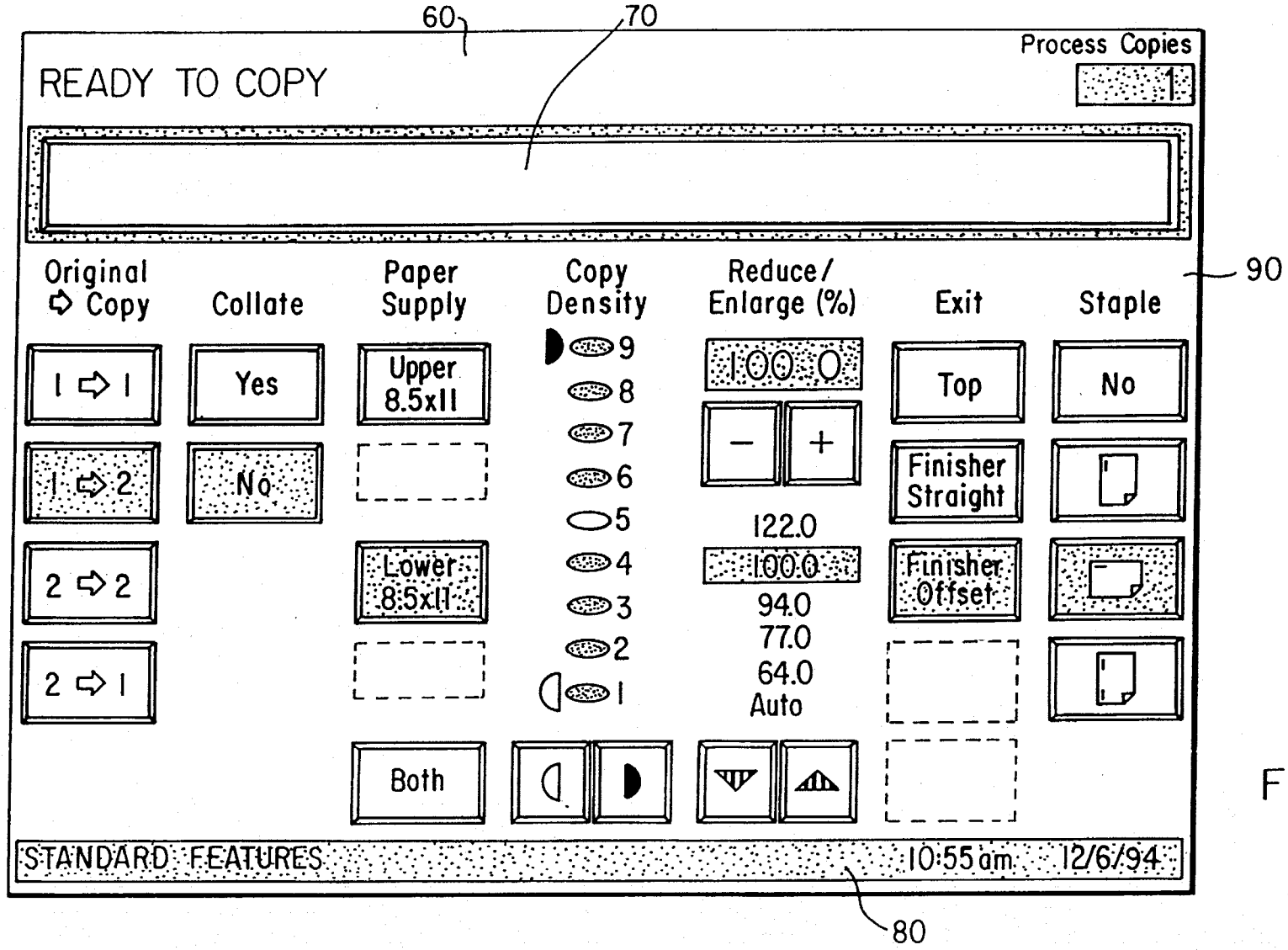
FIG. 8 is a screen like FIG. 6 illustrating the exit from FIG. 7.

A continued description of the exemplary job setup procedure started above with respect to FIGS. 5–7, will further illustrate one preferred embodiment of selections summarizing in accord with the present invention. Assume for example that after noting, on the overview screen in FIG. 7, that no job level features or page level features had been defined, the operator desired to make selections regarding such operating features. The operator at this stage can touch the exit region of screen in FIG. 7, or toggle the summary key on panel 13, and the standard features selection screen, as updated with operator selections, will be readdressed onto device 20, see FIG. 8.

Figure 9:
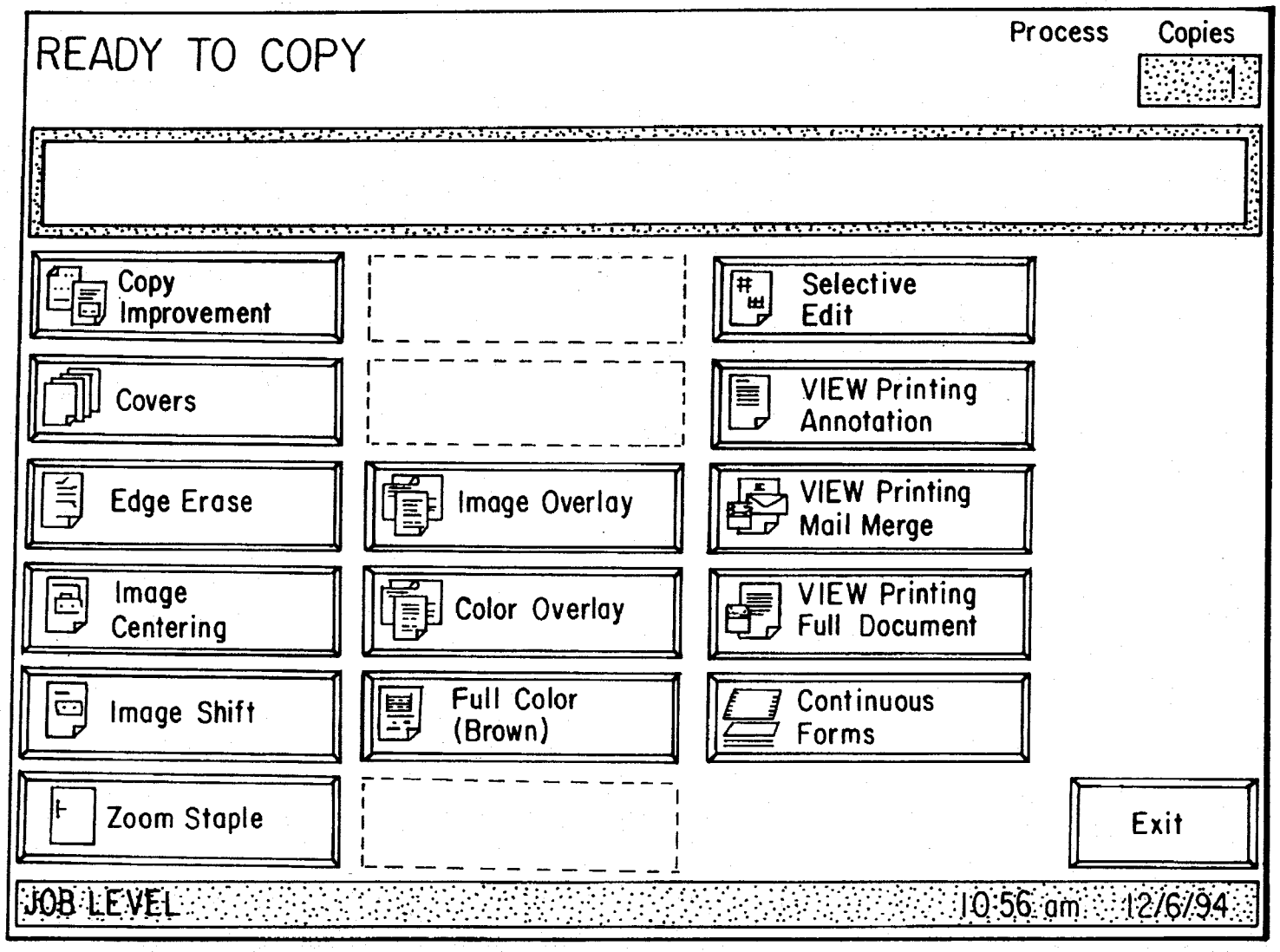
FIG. 9 is a front view of the FIG. 1 display device showing addressed thereon a job level operating feature selection screen.
Figure 10:
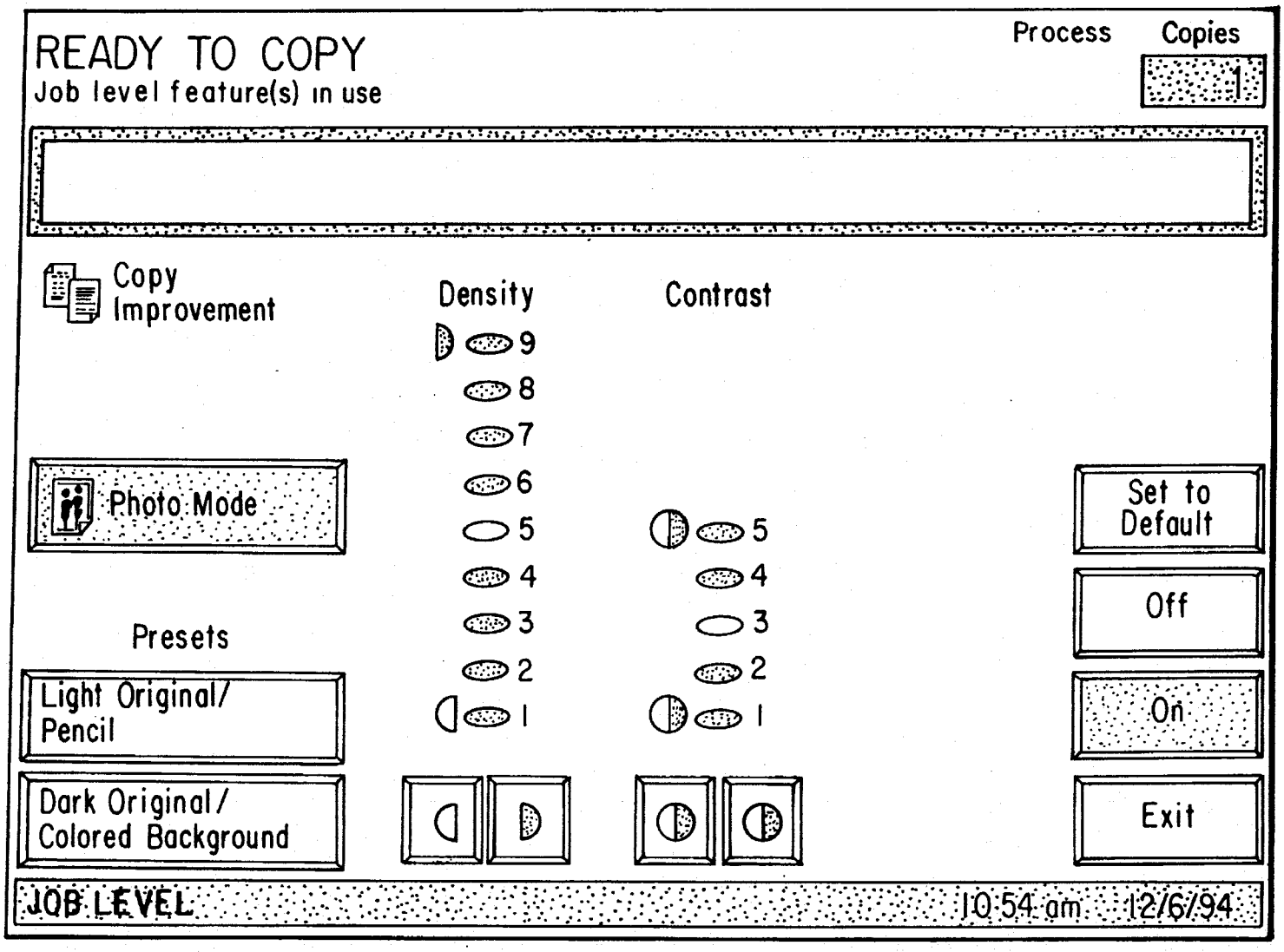
FIG. 10 is a front view showing a job level operating features selection sub-screen addressed on the display device.

The operator then actuates the job level selection key 41 on panel 13 and the job level operating features selection screen shown in FIG. 9 is addressed onto display device 11. The screen lists a plurality of operating features which can be selected for effecting copying at the job level, which in this context refers to the feature applying to every page of the output copy set. Thus, if the operator wishes to effect a "copy improvement" operating feature for the job, that touch region on the selection screen of FIG. 9 is actuated and the copy improvement sub-screen shown in FIG. 10 is addressed onto display device 11. In this example, the user selects the photo mode of copy improvement, by touch address of that region of the FIG. 10 screen, and then touches the exit screen region to return to job level operating features selection screen (which now indicates, FIG. 11, that copy improvement has been selected).

Figure 11:
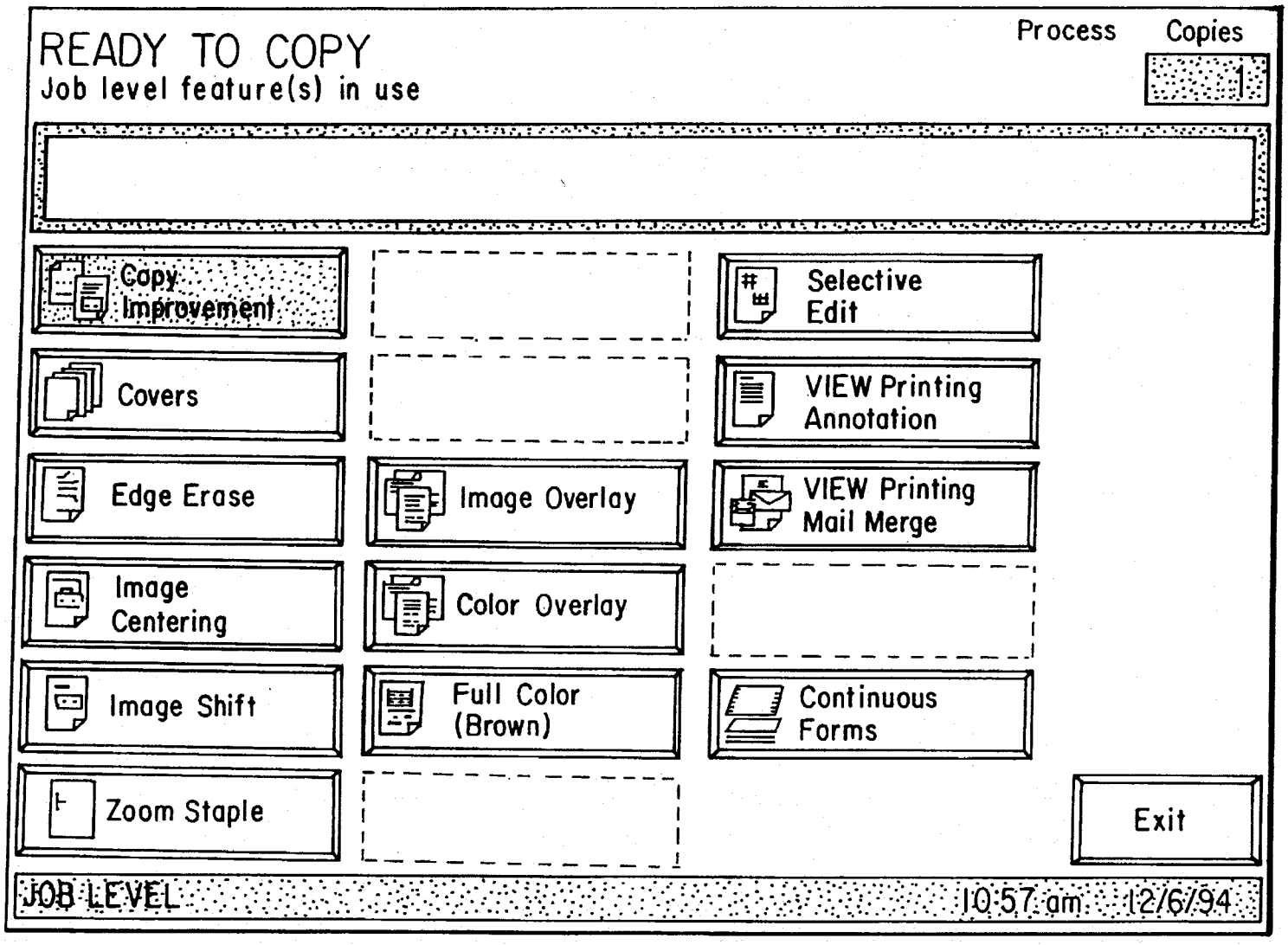
FIGS. 11–14 illustrate other job level operating features selection screen and sub-screen displays upon the reproduction apparatus display device.
Figure 12:
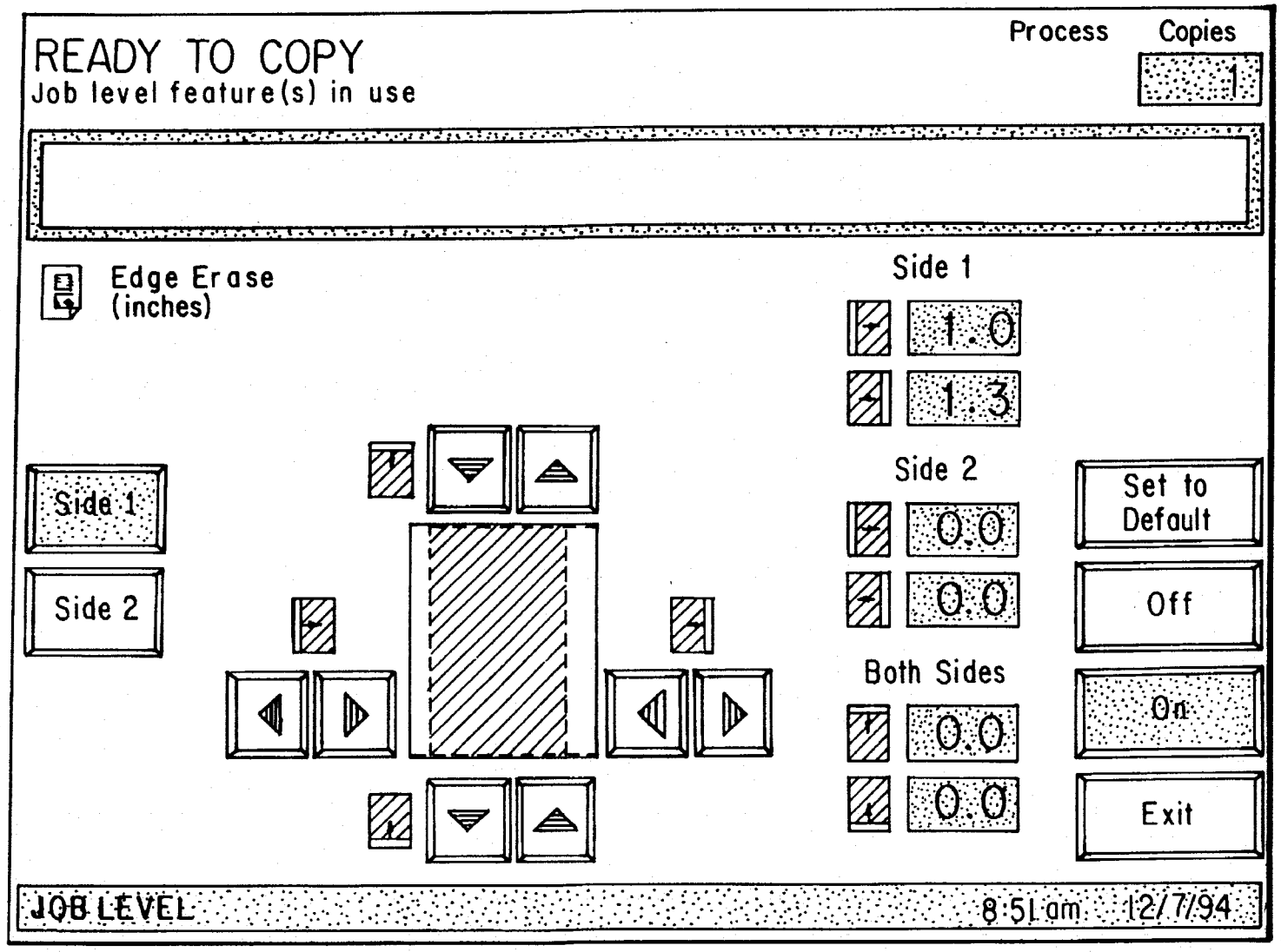
Figure 13:
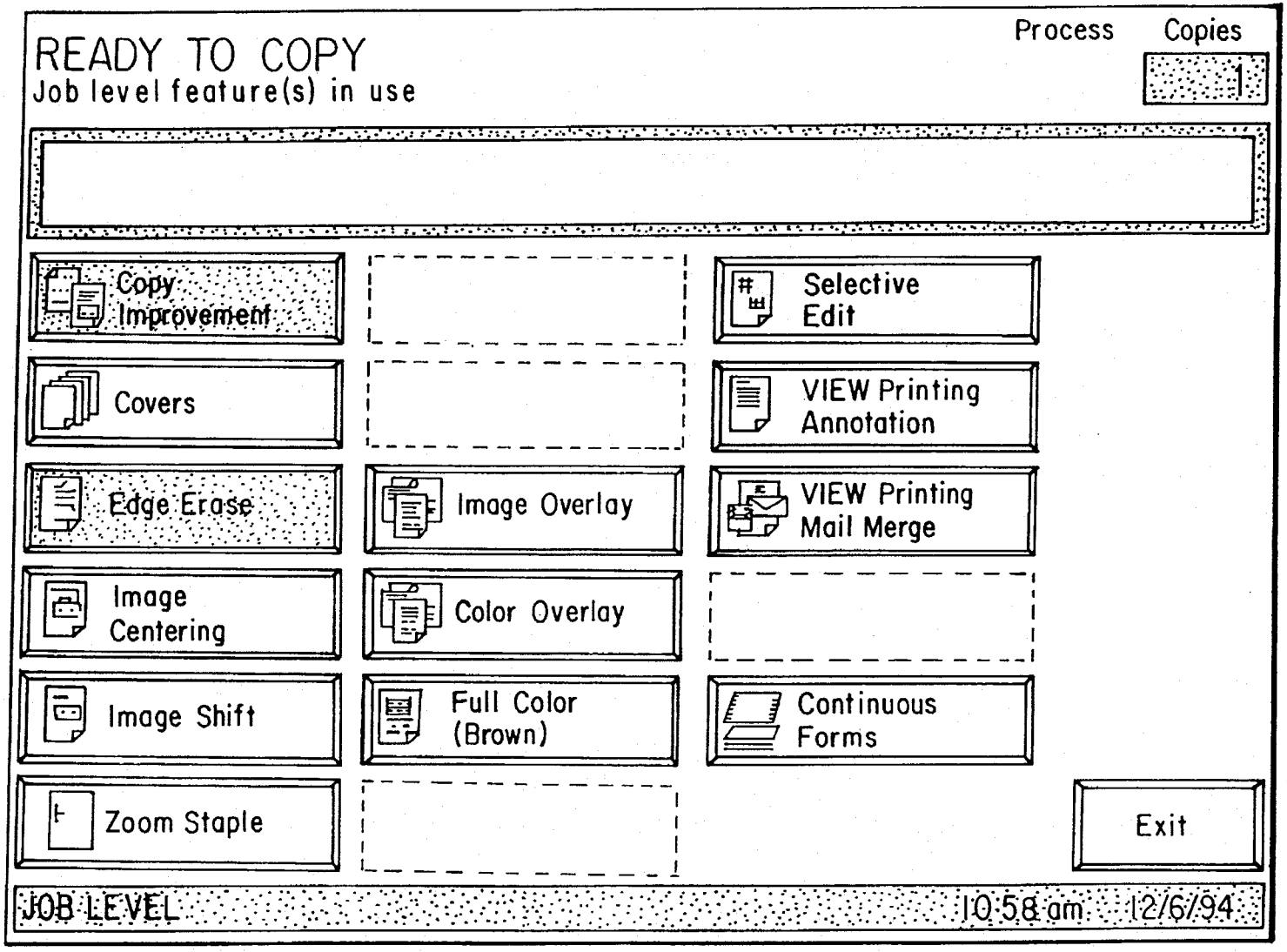
Figure 14:
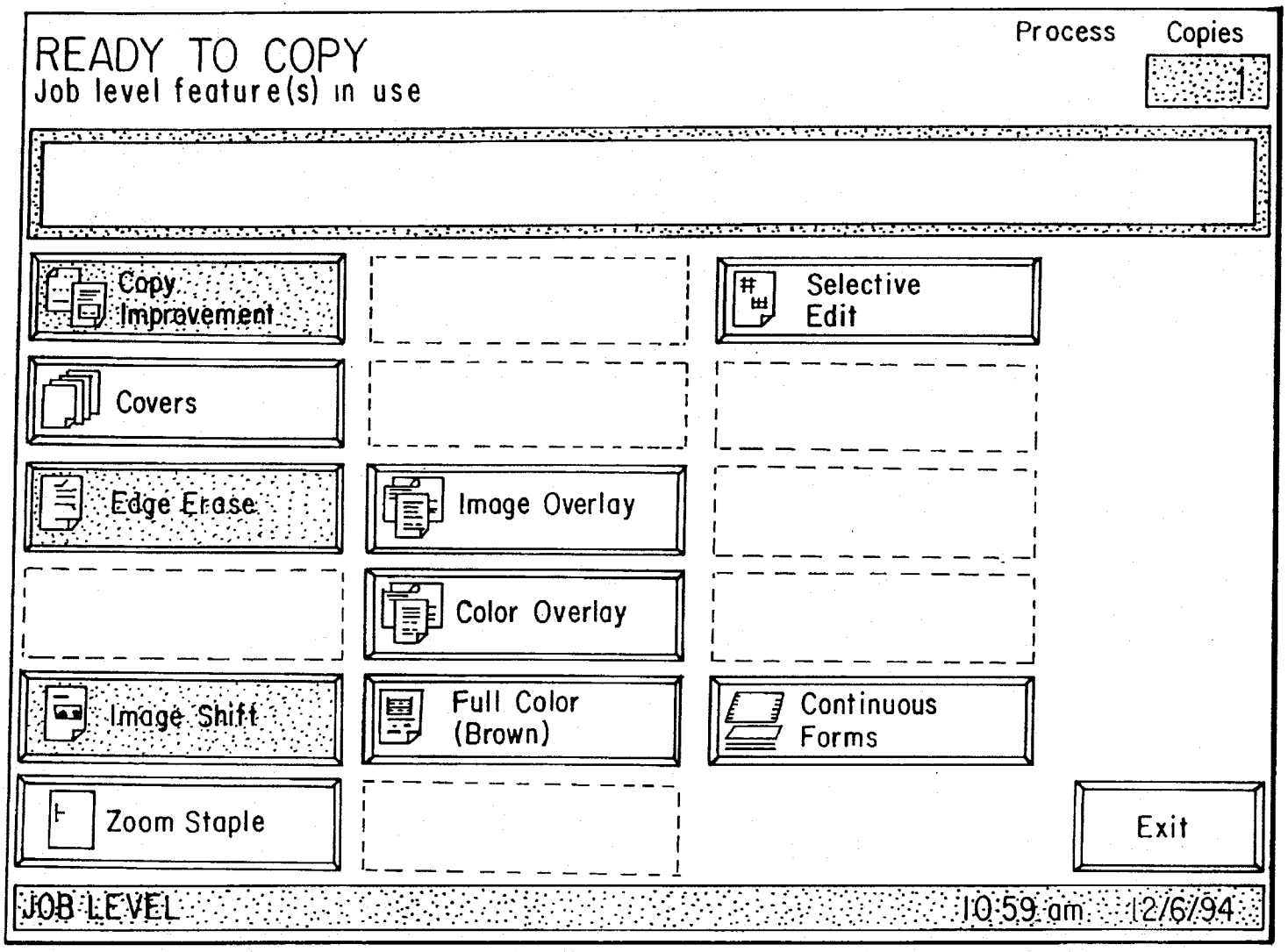

Continuing the example setup, the operator selects another job level feature, "edge erase", by touching that region of the FIG. 11 screen and the edge erase sub-screen shown in FIG. 12 is addressed onto display device 11. The user makes the desired erase selections for the right and left margins of side 1 of the copy sheets by manipulating the appropriate touch address regions of the FIG. 12 screen. The operator then actuates the exit region to again return to the job level operating features selection screen (now shown in FIG. 13 to indicate edge erase to be a selected job level feature). In a similar manner the operator can select other features from the job level operating features selections screen of FIG. 13, to address the appropriate other sub-screens, effect desired inputs and then return as just described. Thus, FIG. 14 shows for our example that such a selection of image shift has been effected, and it will be understood that others, in addition, could occur.

Figure 15:
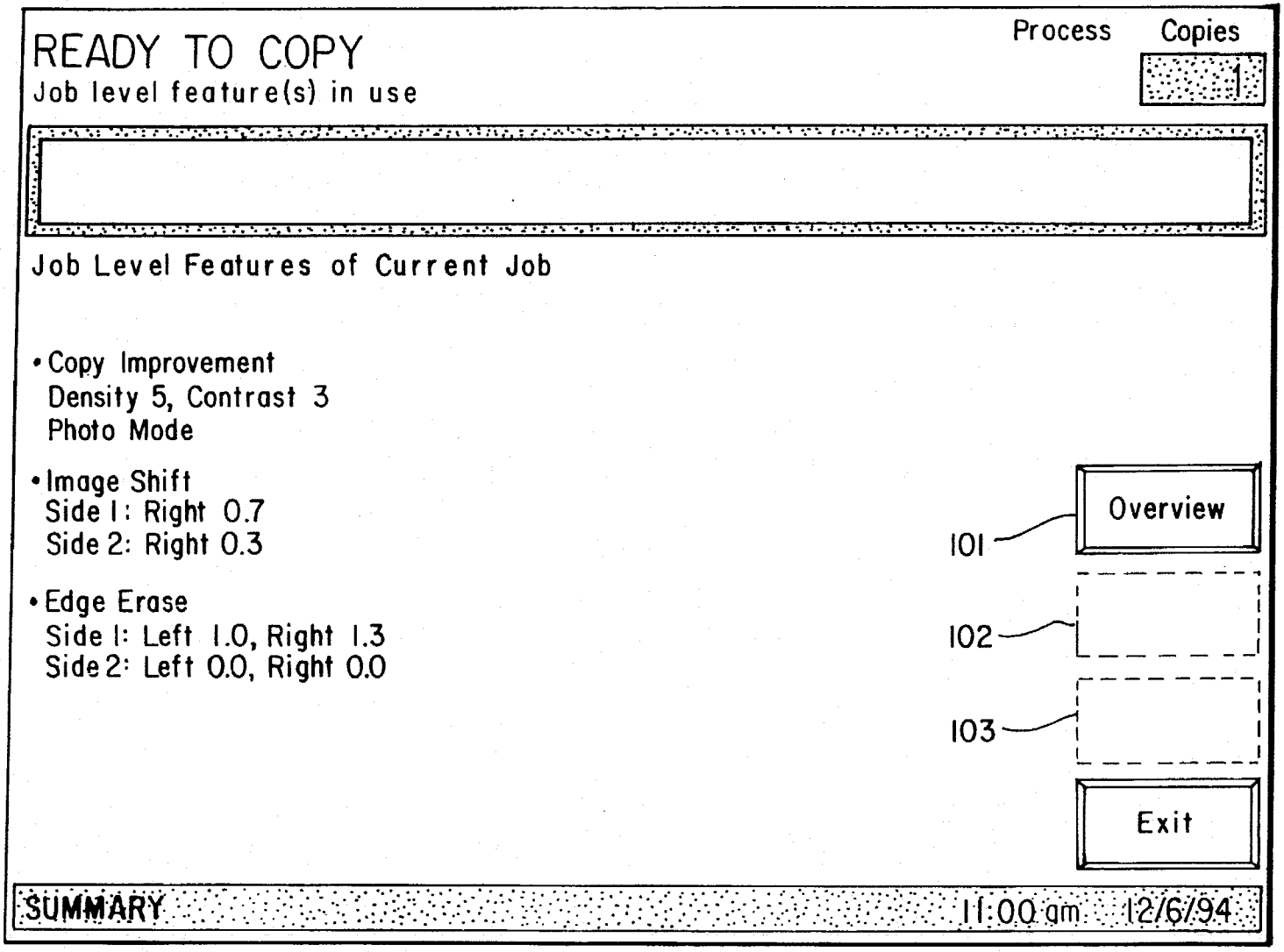
FIG. 15 illustrates a job level summary screen, according to the invention, reflecting feature selections made during the FIGS. 9–14 routines.

Assuming the operator, at this stage, wishes to check on job level operating features selections, the summary key 49 on keyboard 13 is actuated. In response, the job level features selections summary screen, shown in FIG. 15, is addressed onto display device 11, from the memory of logic unit L, which has received from device 11, and stored, the signals representing the job level operating feature selection described above. As shown in FIG. 15, the selected job level operating features are summarized without the clutter of the many non-selected features that exist on the menu shown in FIG. 14 (and the many sub-screens thereof). When review of the FIG. 15 screen is complete, exit region actuation returns screen of FIG. 14.

Figure 16:
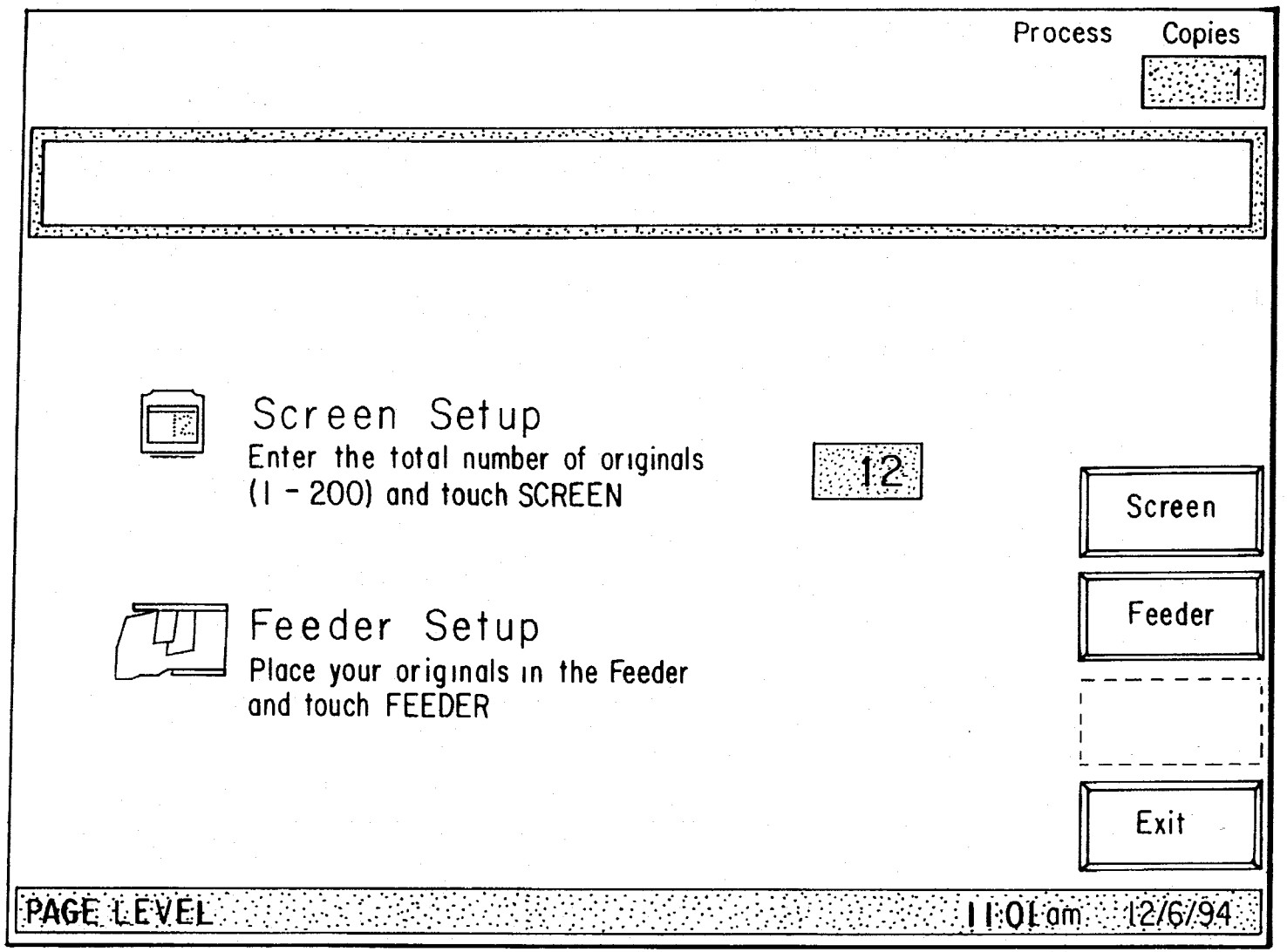
FIG. 16 shows a page level method setup screen on the display device of the reproductive apparatus.
Figure 18:
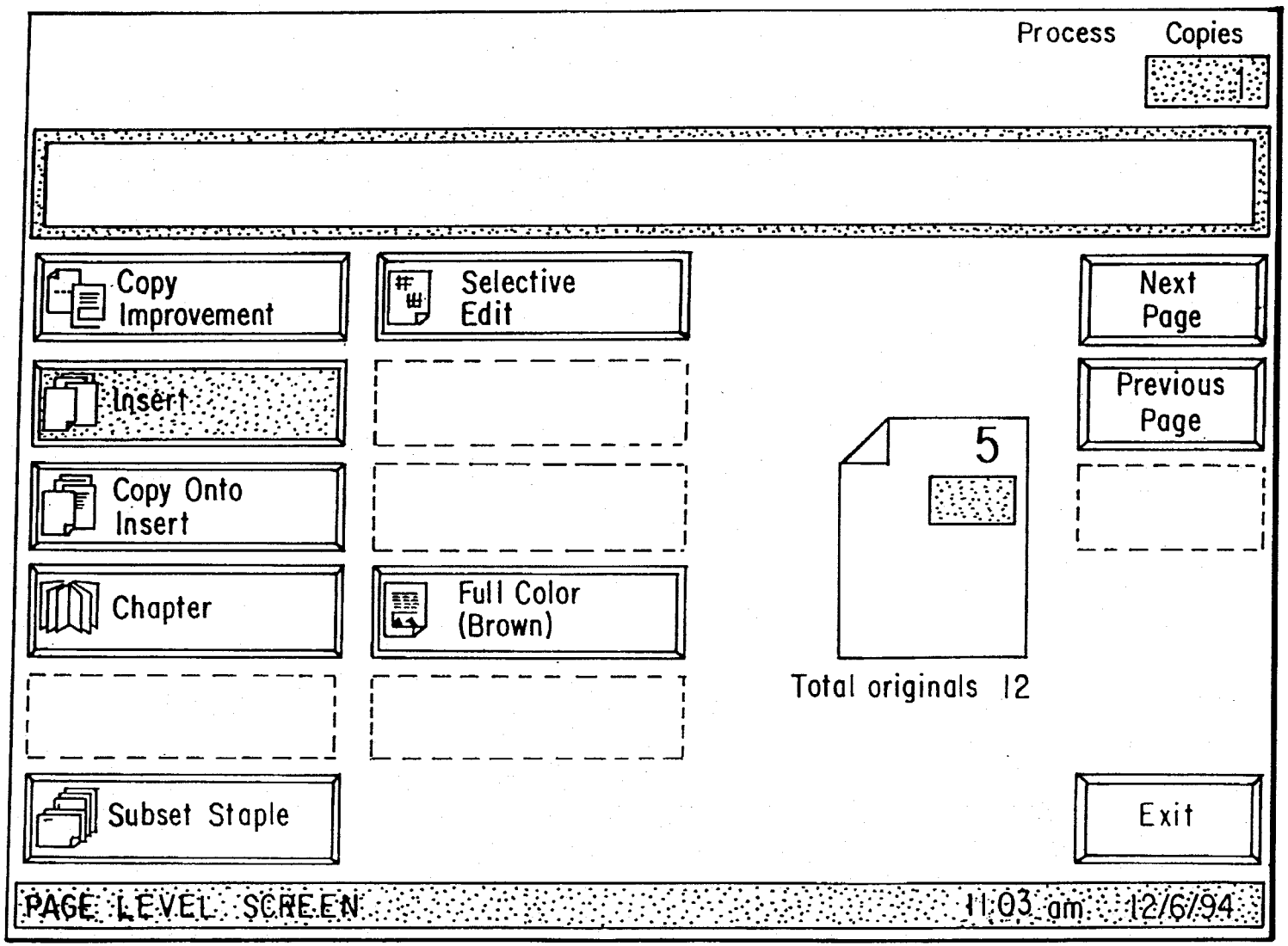
Figure 19:
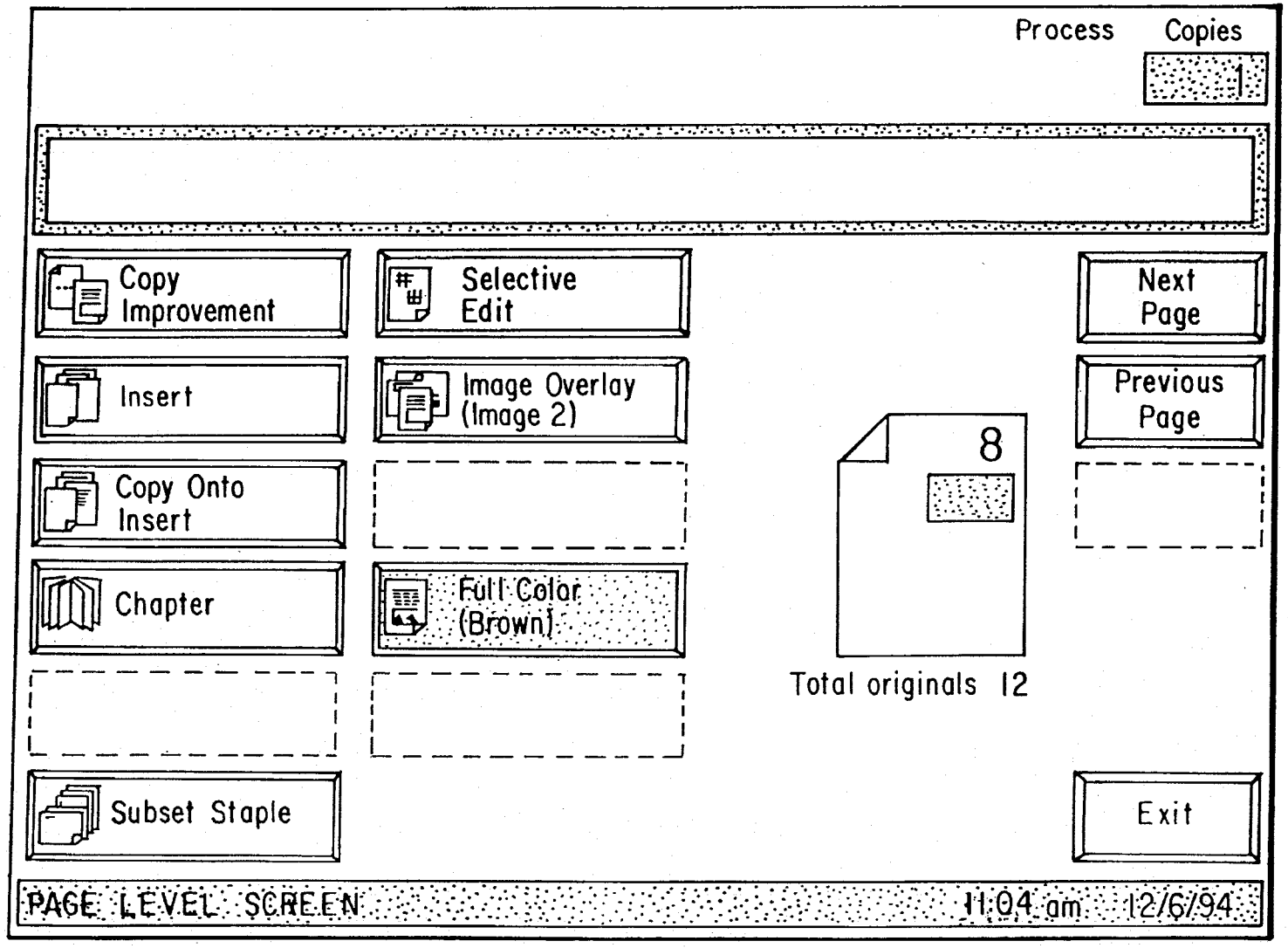

Assume next, the operator wishes to select some page level operating features for the copy job setup. In this context, page level features refers to features for effecting only a certain page(s) of the output copy set. To commence this stage, the operator actuates the page level selection key 42 on keyboard 13. In response the page method setup screen is addressed from memory (e.g., ROM) of logic unit L onto display device 11 and the operator sets the number of originals (12) in the set and touches the "screen" button on the FIG. 16 screen to access (i.e., cause address onto device 20) the page level operating features selection screen. FIG. 17 illustrates such screen in its condition, after the operator has actuated the "next page" button thereon once, to advance the page designated for operating features selections to page (2). The operator then touches the "insert" address region of screen 17 to select an insert operating feature and actuates the "next page" button 3 times to designate page 5 for the next feature selection (see FIG. 18). The operator again selects the insert operating feature and actuates the "next page" button three more times to designate page 8 for the next page level operating feature selection. In this instance, (see FIG. 19) the full color operating feature is selected.

Figure 20:
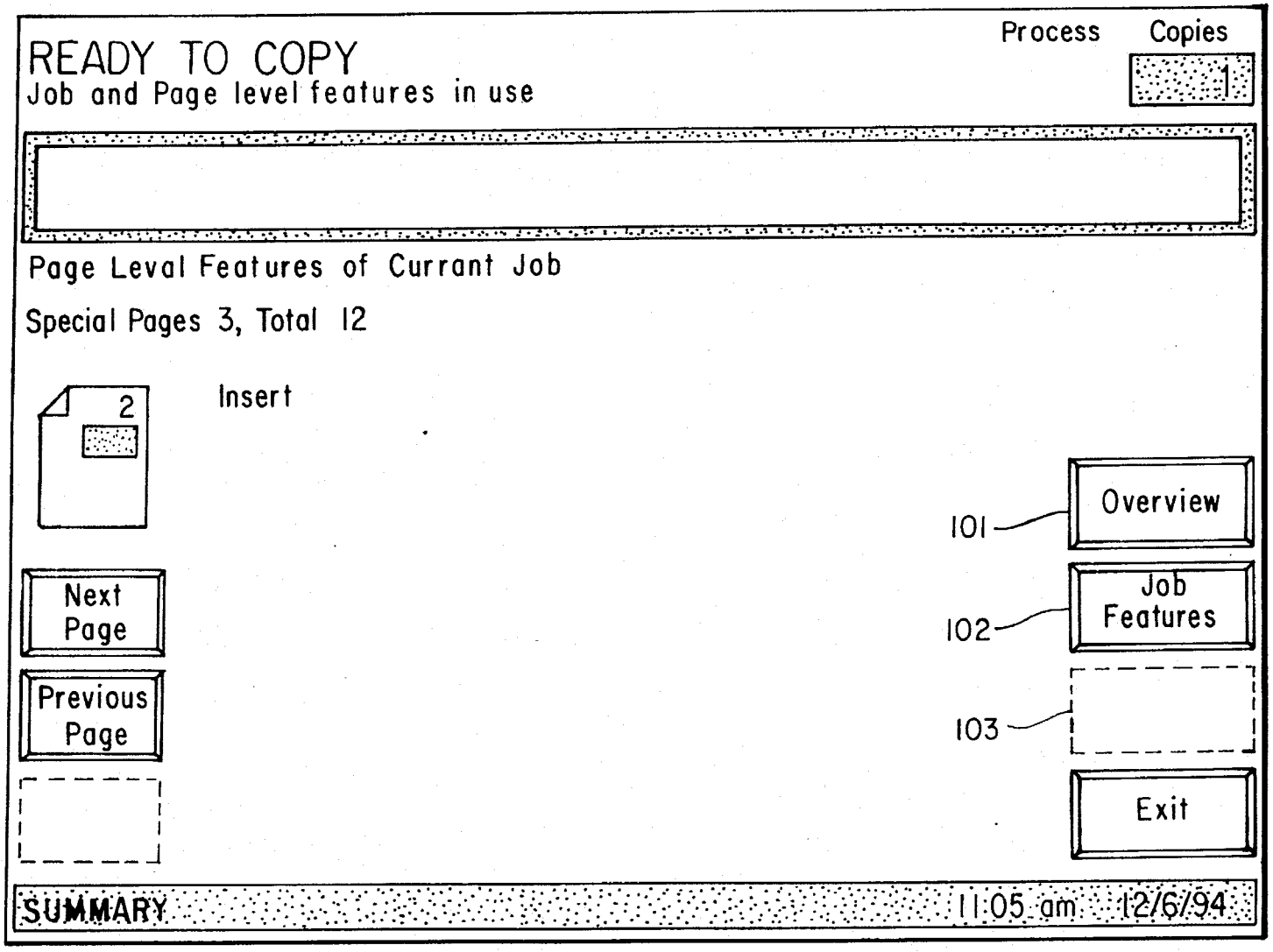
FIGS. 20–22 show page level summary screens according to the invention indicating the page level feature selections made via the FIGS. 18–20 screens.
Figure 21:
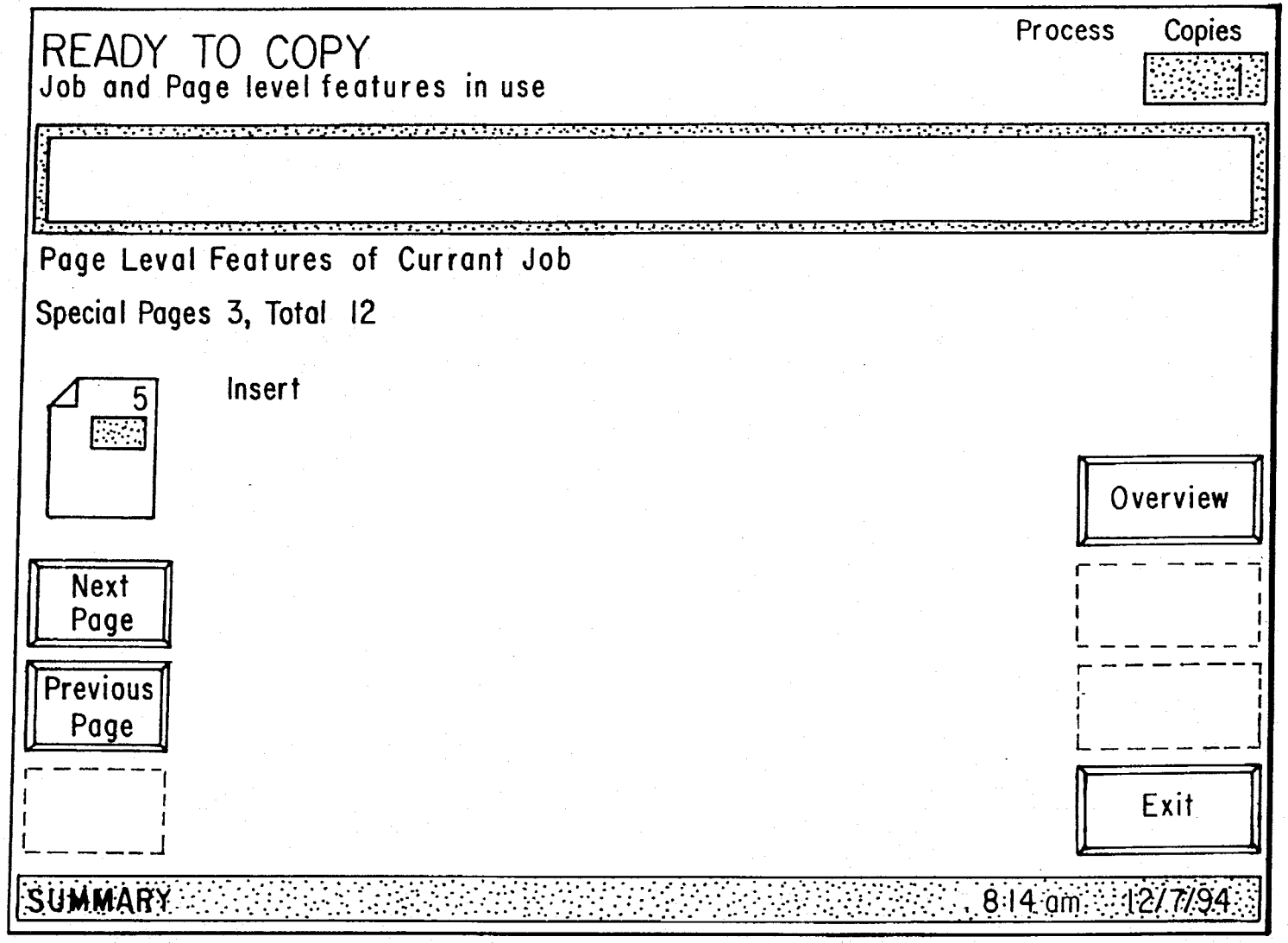
Figure 22:
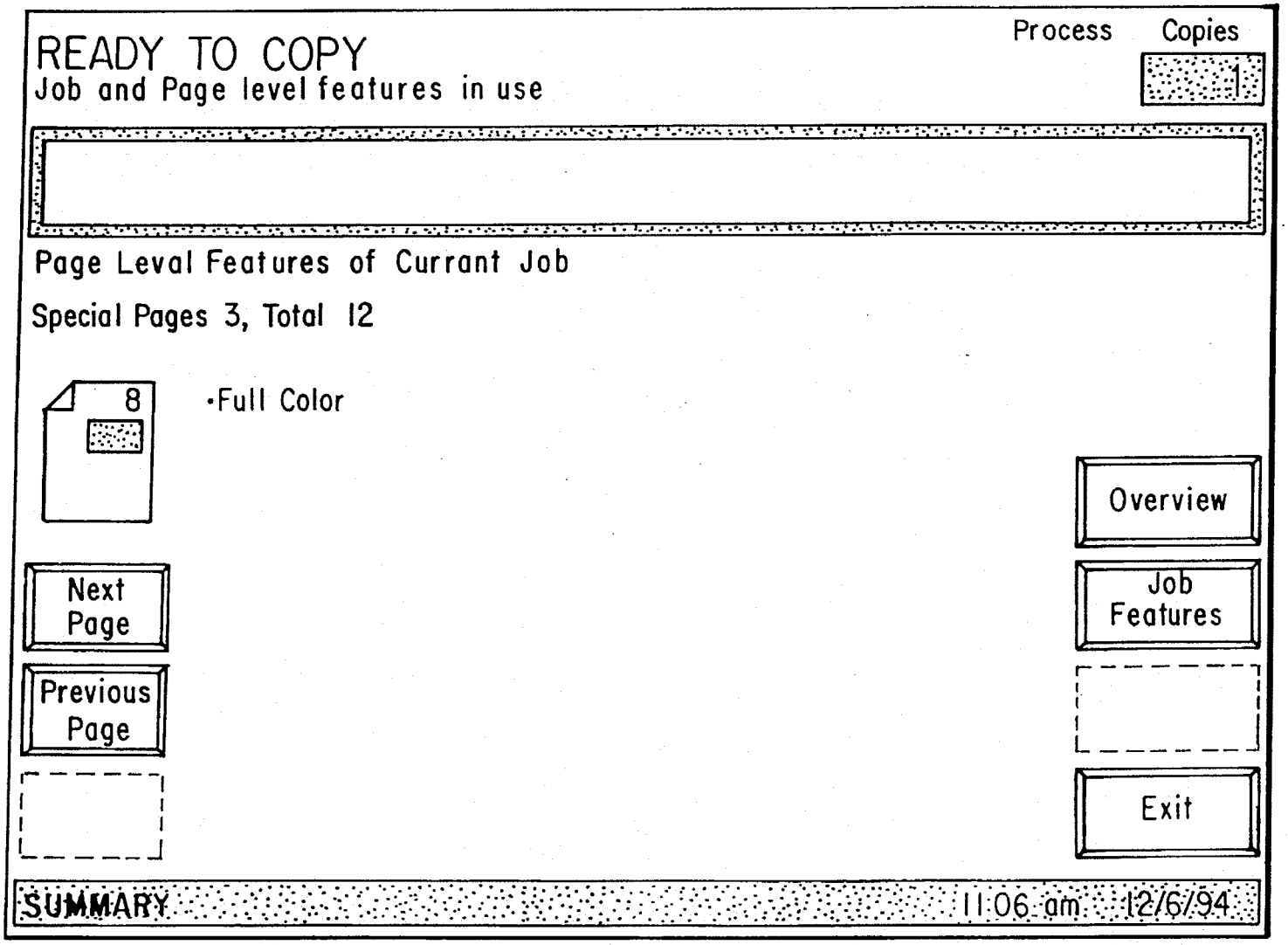

Assume at this stage the operator wishes to review the page level selections. The summary key 49 on panel 13 is again actuated (the same as with respect to a request for overview and page level summaries); however, in this instance the request is from a page level stage of the operator setup, and the page level operating features selection summary screen shown in FIG. 20 is addressed onto display device 11. As illustrated the screen of FIG. 20 summarizes that there are 3 special pages within the total of 12 pages shows the selection for the first special page (2) to be an insert. Addressing the "next page" region on the screen of FIG. 20, the operator can quickly determine that the other selections were on page 5, an insert, and page 8, full color (see FIGS. 21 and 22). The page level summary review being complete, the operator can touch the screen exit region or toggle the summary key 49 to return to the method setup screen shown in FIG. 16. From this point the operator can actuate "exit" to return to the standard features screen and operate the start key 45 on panel 13 to commence the copy run.

Figure 23:
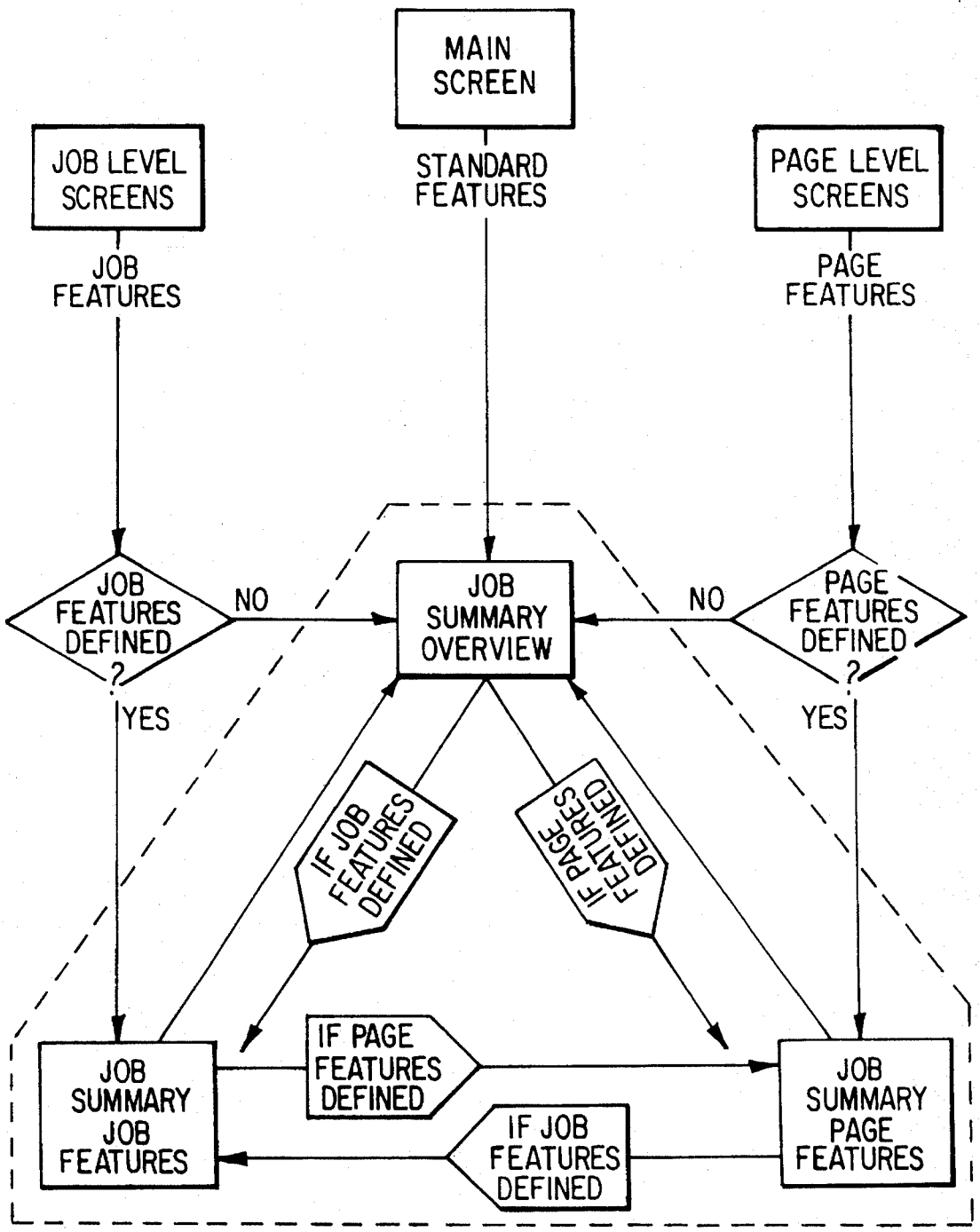
FIG. 23 illustrates one preferred navigation flow chart in accord with the present invention.

From the foregoing exemplary setup operation, it can be appreciated that the divided summaries, without display of any non-selected features, provide excellent input for the operator at the various stages of the process. Moreover, with some reflection, it can be appreciated that the simple actuation of the summary key 49 yields different results at different stages of the setup process. Thus during the standard features selections stage, the actuation of summary key 49 causes display of the standard features/overview summarization screen (e.g., see FIG. 7). During the job level setup stage, actuation of summary key 49 causes display of the job level summarization screen (see FIG. 15) and during the page level stage, actuation of the summary key 49 causes display of the page level summarization screen(s), see FIGS. 20–22. FIG. 23 is a summary navigation flow chart which illustrates these capabilities, effected by the logic and control program stored in memory (e.g., ROM) of the logic unit L.

FIG. 23 also indicates that the present invention provides for inter-summary navigation during the set up process. Thus, as shown in FIG. 23, when an operator is viewing any one of the summary screens (e.g., such as the FIG. 7, FIG. 15, or FIG. 20 screens), the other summary screens are directly addressable, if features thereof have been defined. More particularly, if the FIG. 7 screen is displayed and if job features and page features have been defined, the touch regions 102 and 103 will be highlighted, indicating availability to be touch activated to effect address of the job features or page features summary screens onto the display device 11. Similarly, if the FIG. 15 job summary screen is displayed and standard and page features are defined (selected), the touch regions 101 and 103 will be highlighted, indication availability to be touch activated to effect address of the overview of page features summary screens onto the display device 11. Touch regions are muted (i.e., non-highlighted) either when the screen designated thereby is already displayed or when no features of such summary screen are defined. Thus, considering the page level summary screen shown in FIG. 20, the job and overview touch regions 101,102 are highlighted, indicating that they are available to be addressed onto device 11, but the page features touch region 103 is muted because the screen is currently displayed on device 11.

Figure 25:
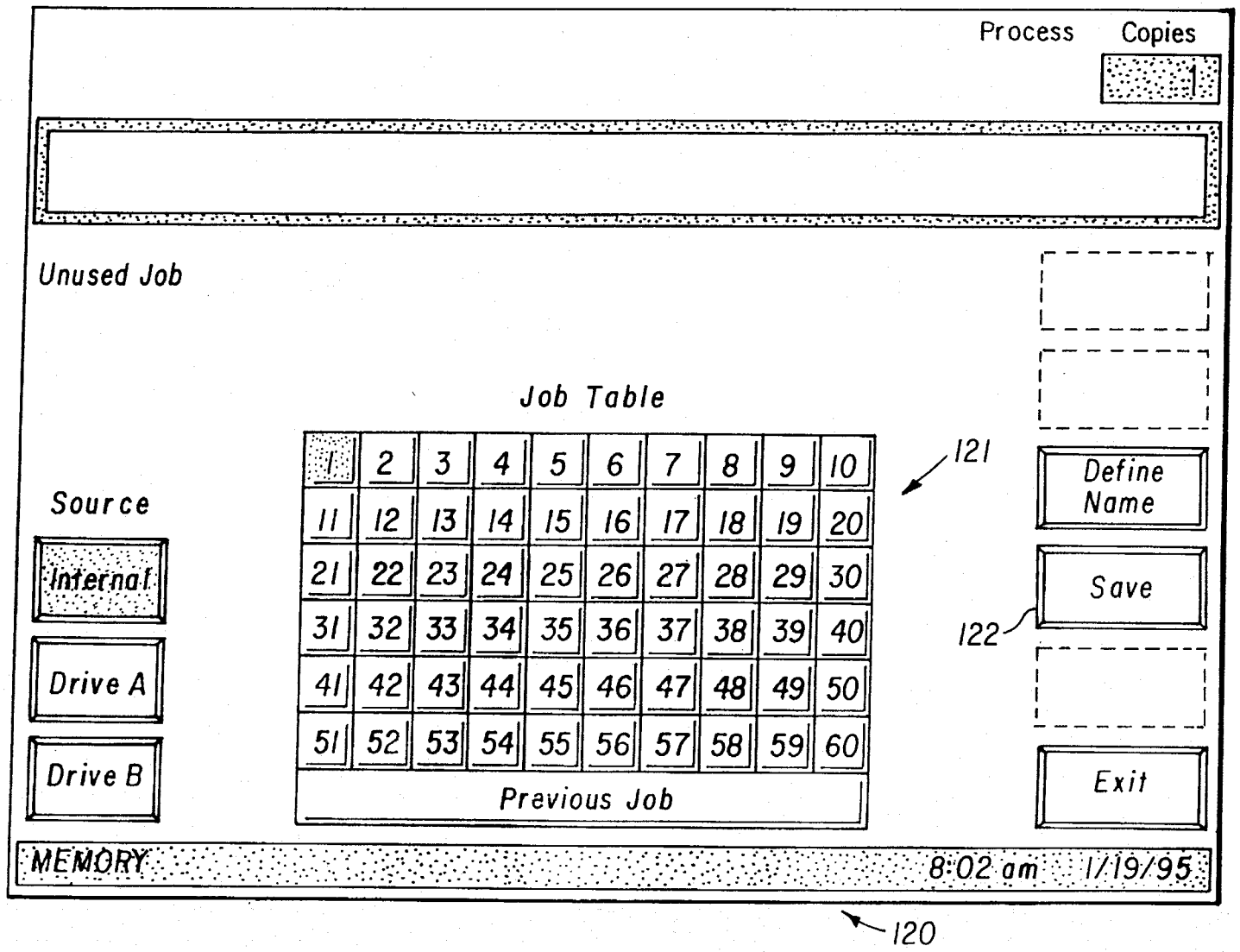
FIGS. 25 and 26 show job/store retrieve memory screens useful in accord with a feature of the present invention.

In accord with yet further advantageous features of the present invention, job set ups can be stored as "saved jobs" in apparatus memory and subsequently retrieved and examined to ascertain their selected operating features in a summarized format described above with respect to a current job. More particularly, concurrently filed U.S. application Ser. No. 08/398,467, U.S. Pat. No. 5,500,717 entitled "Improved Job Storage/Retrieval System and Method for Reprographic Apparatus" by F. E. Altrieth III, describes the details of a useful system with which the present invention can be combined to enable retrieval and selected feature examination in accord with this aspect of the invention, and that application is incorporated herein by reference. Thus, FIG. 25 shows a job store/retrieve memory screen 120 such as described in that application which can be addressed onto the display device 11 by the operator actuating memory key 43 on panel 13 to allow the operator to save and retrieve jobs in accord with the teachings of the Altrieth application. The various operating feature selections for a given job can be stored in a hard memory portion of the logic unit L by actuation of a "save" touch region 122, together with a job number designation selected from job table key regions 121. A word/phrase job description (or other such recognizable character string) can also be stored to assist the operator in subsequent recognition of the job, as described in more detail in the above referenced application.

Figure 24:
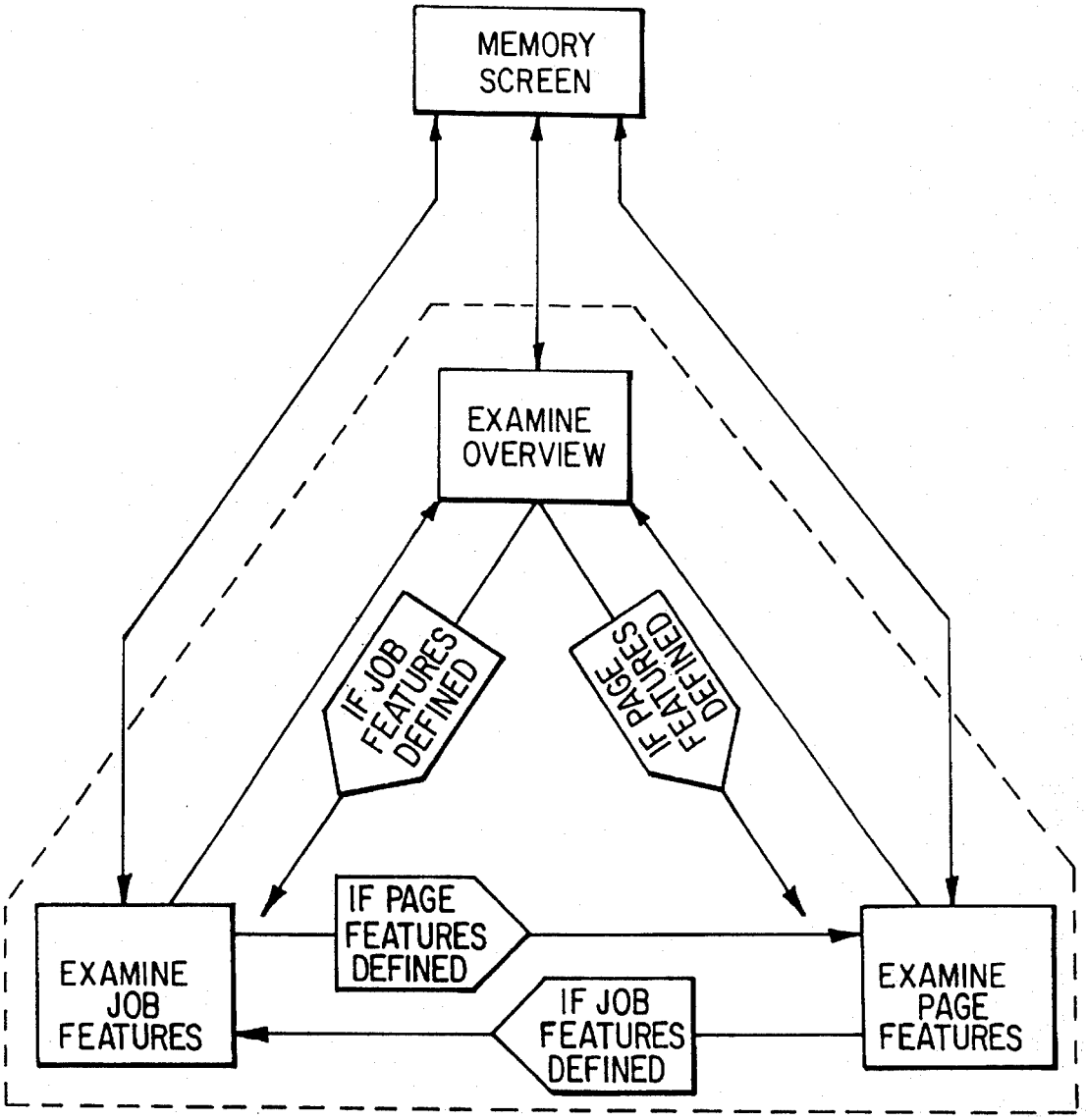
FIG. 24 shows an examine navigation chart according to the present invention.

FIG. 24 shows an "examine" navigation system, similar to the FIG. 23 "summary" navigation system, but illustrating how the present invention enables direct access between the different selected operating feature summarizations of saved jobs (rather than of a current job). This, "examine" navigation system and process will be further understood by the following example, which refers to FIGS. 25–29. Thus, assume that a user has previously set up a job as follows:

Standard Features simplex to duplex collated output lower paper supply copy density setting of 5 image reduction of 77% finisher exit both staples

Job Level Features image shift: 0.5 right shift for sides 1 and 2 edge erase: 1.0 of right edge erased for sides 1 and 2

Page Level Features page 1: insert page 2: insert page 3: full color

Figure 26:
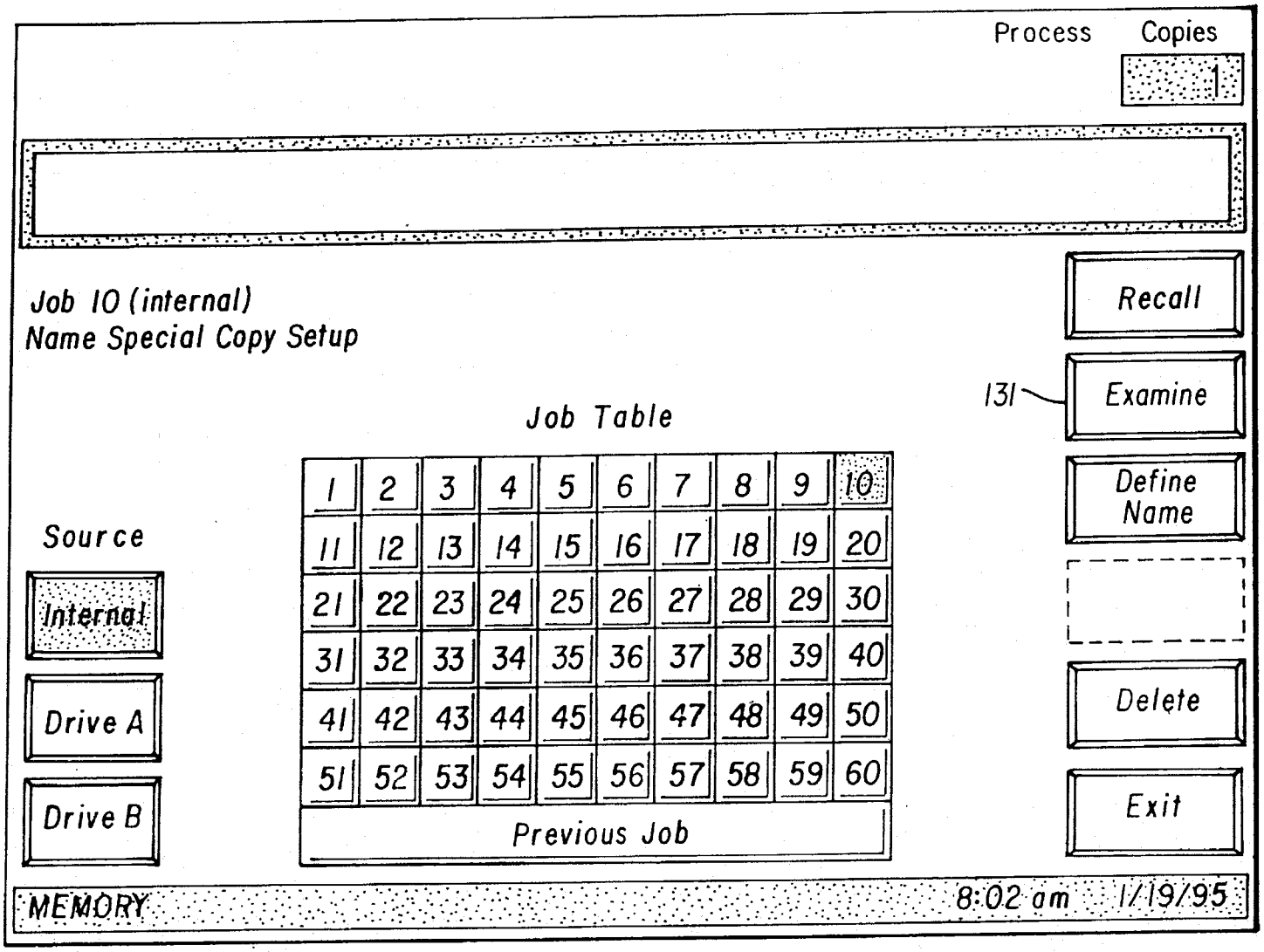

The user saved this job to memory (under a "Job 10" memory allocation number) and named the job "Special Copy Set Up". Subsequently, the user wishes to retrieve and review Job 10, and the user presses the memory hard key 43 on panel 13, which causes the store/retrieve memory screen 120, shown in FIG. 25, to be addressed onto the display device 11. The user then touches the key button 10 on key region of job table 121 and the "Examine" touch region 137 becomes highlighted as shown in FIG. 26. This indicates that the Examine function is available to navigate between the selected features summarizations of the saved "Job 10", named "Special Copy Set Up".

Figure 27:
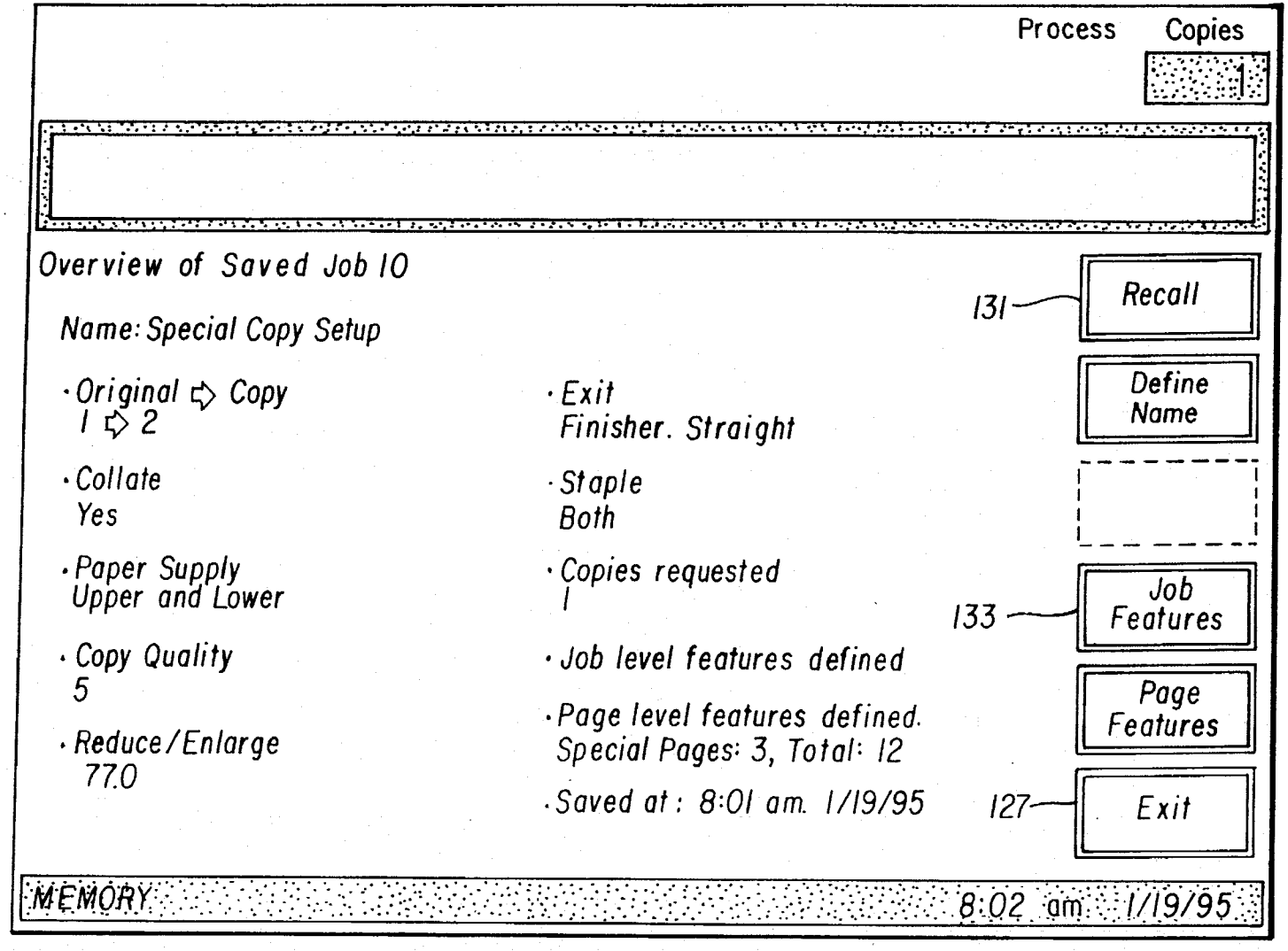
FIGS. 27–29 show examine screen summarizations for stored jobs in accord with the present invention.
Figure 28:
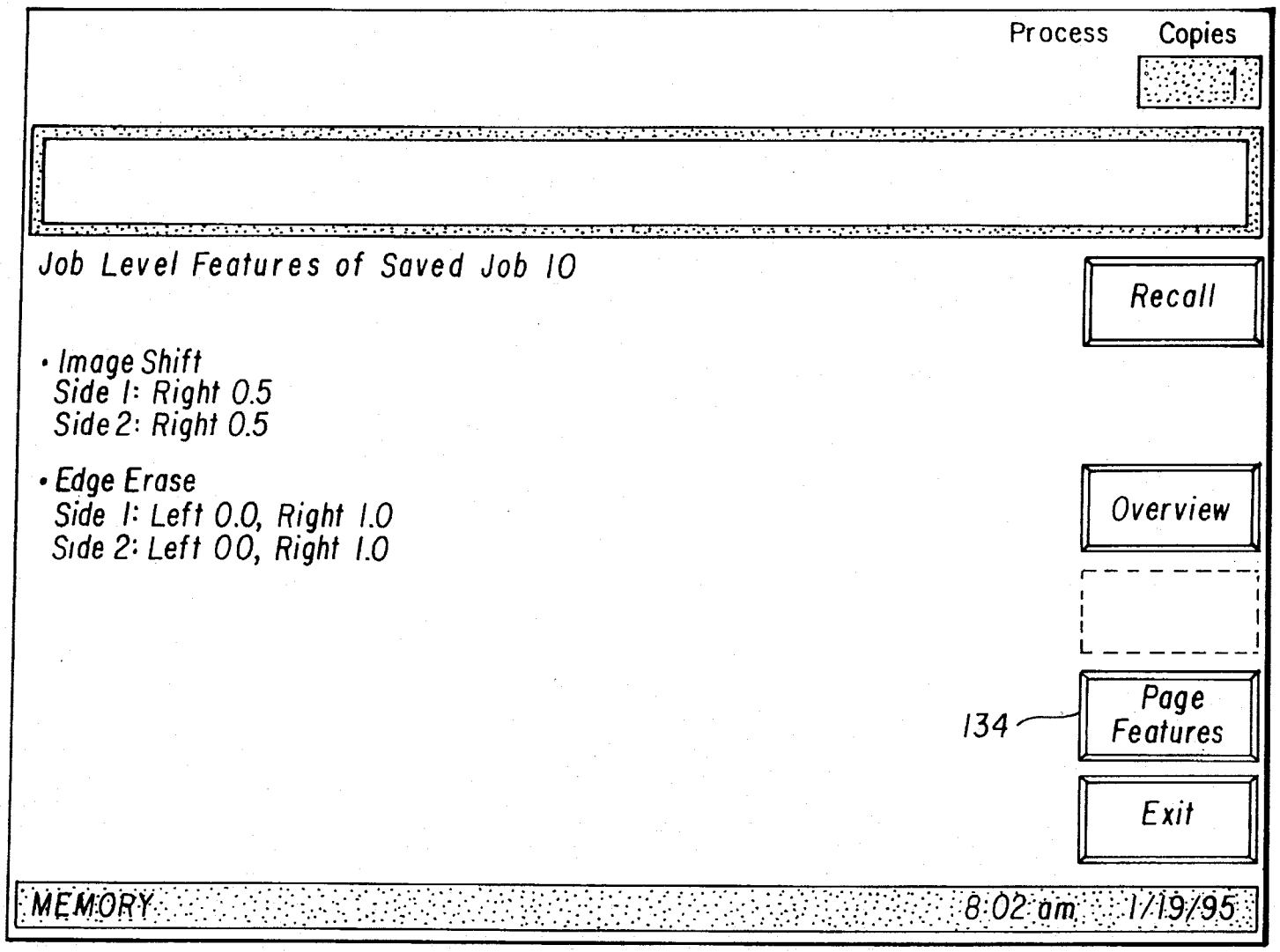

The user next touches the Examine region 137 on the screen of FIG. 26 and the overview examine (i.e., saved job) screen, which is the equivalent for a saved job of the overview summary screen described above, is addressed onto the display device 11, as shown in FIG. 27. If, at this stage, the user touches the "exit" region 127 on the FIG. 27 screen, the user is returned to the memory screen shown in FIG. 26. As another option, the user can touch the "recall" region 131 on the screen of FIG. 27, which will recall the saved job to a current job status (in RAM of logic unit L) and display the standard features screen shown in FIG. 5. However, since the user is reviewing the saved job, the user touches the "job features" region 133 of the FIG. 27 screen and the job level features the examine (i.e., saved job) screen for saved job 10 is addressed onto the screen of display device 11, as shown in FIG. 28. The "exit" and "recall" touch regions on the FIG. 28 screen will function as described regarding the FIG. 27 screen.

Since the user has not completed the saved job review, assume such activity continues and the user touches the "page features" region 134 on the FIG. 28 screen. Such actuation causes the page level features examine (i.e., saved job) screen shown in FIG. 27 to be addressed onto the display device 11. The "exit" and "recall" regions on the FIG. 29 screen function as described regarding the FIG. 29 screen, and the user can complete the review of selected features summarizations by touching the "next page" region 139 to move the summarizations for defined page level features on pages 2 and 3.

Figure 29:
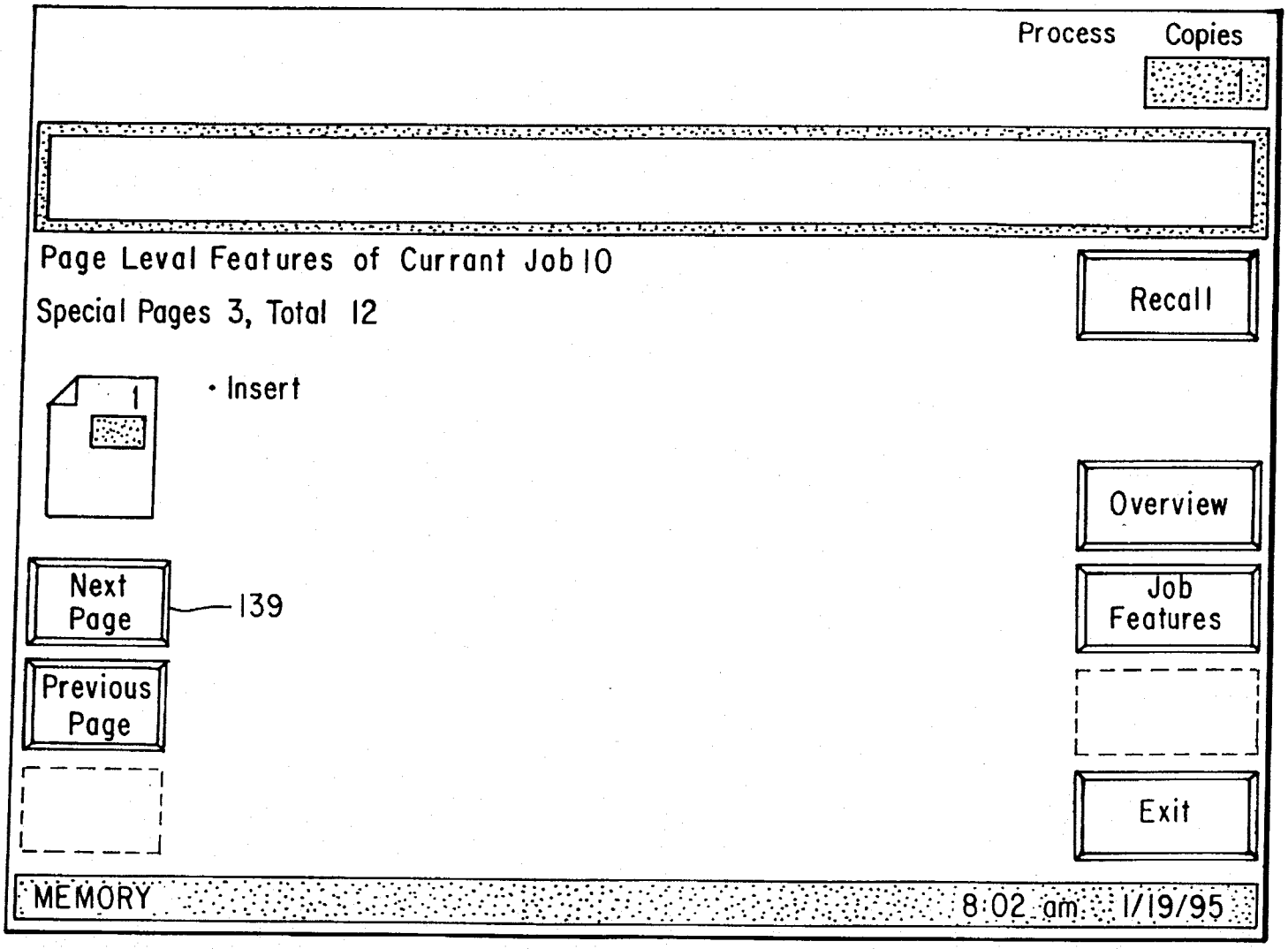
Figure 30:
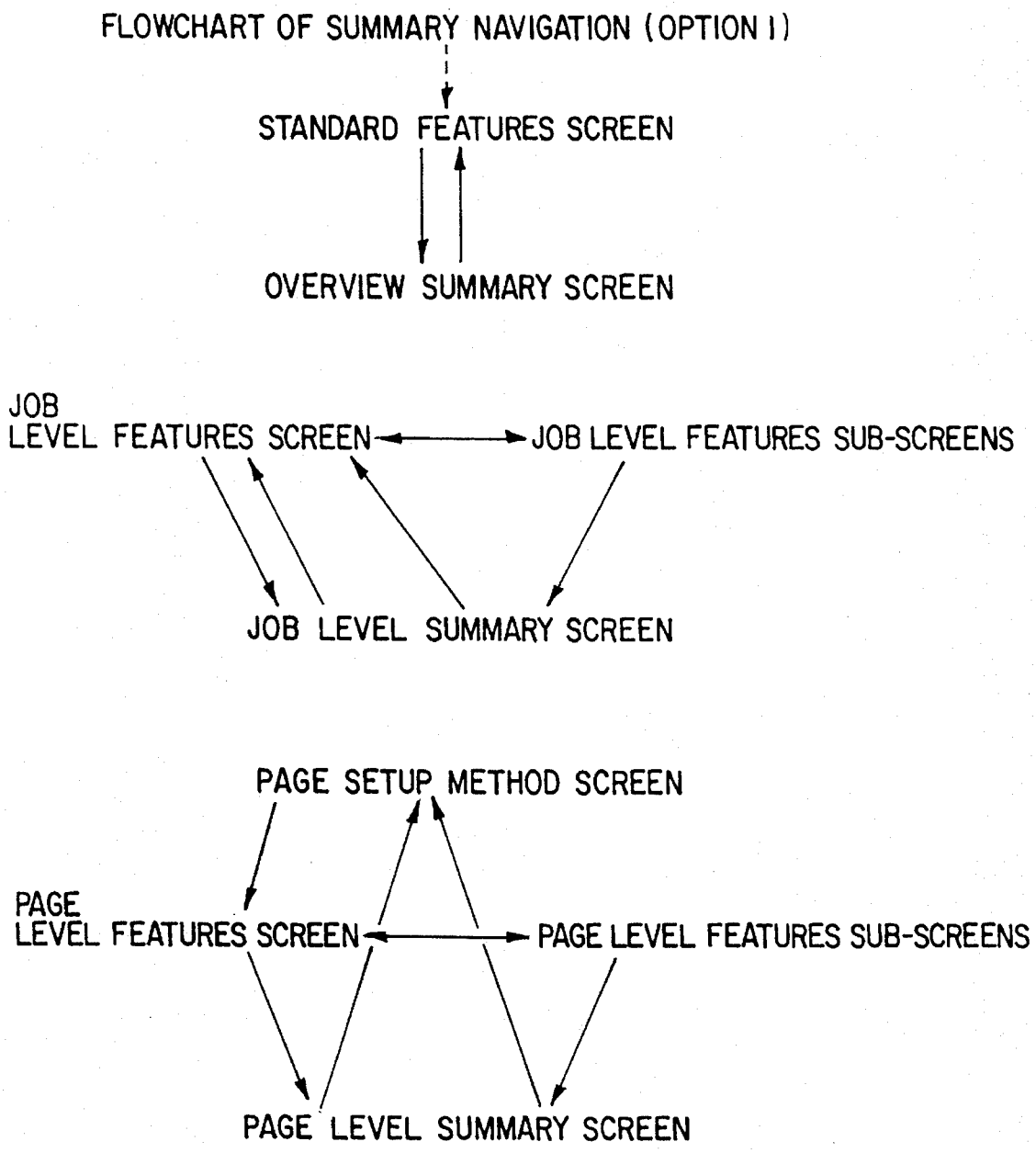
FIGS. 30–32 show alternative summary navigation flowcharts indicating alternative exit paths according to embodiment of the invention.
Figure 31:
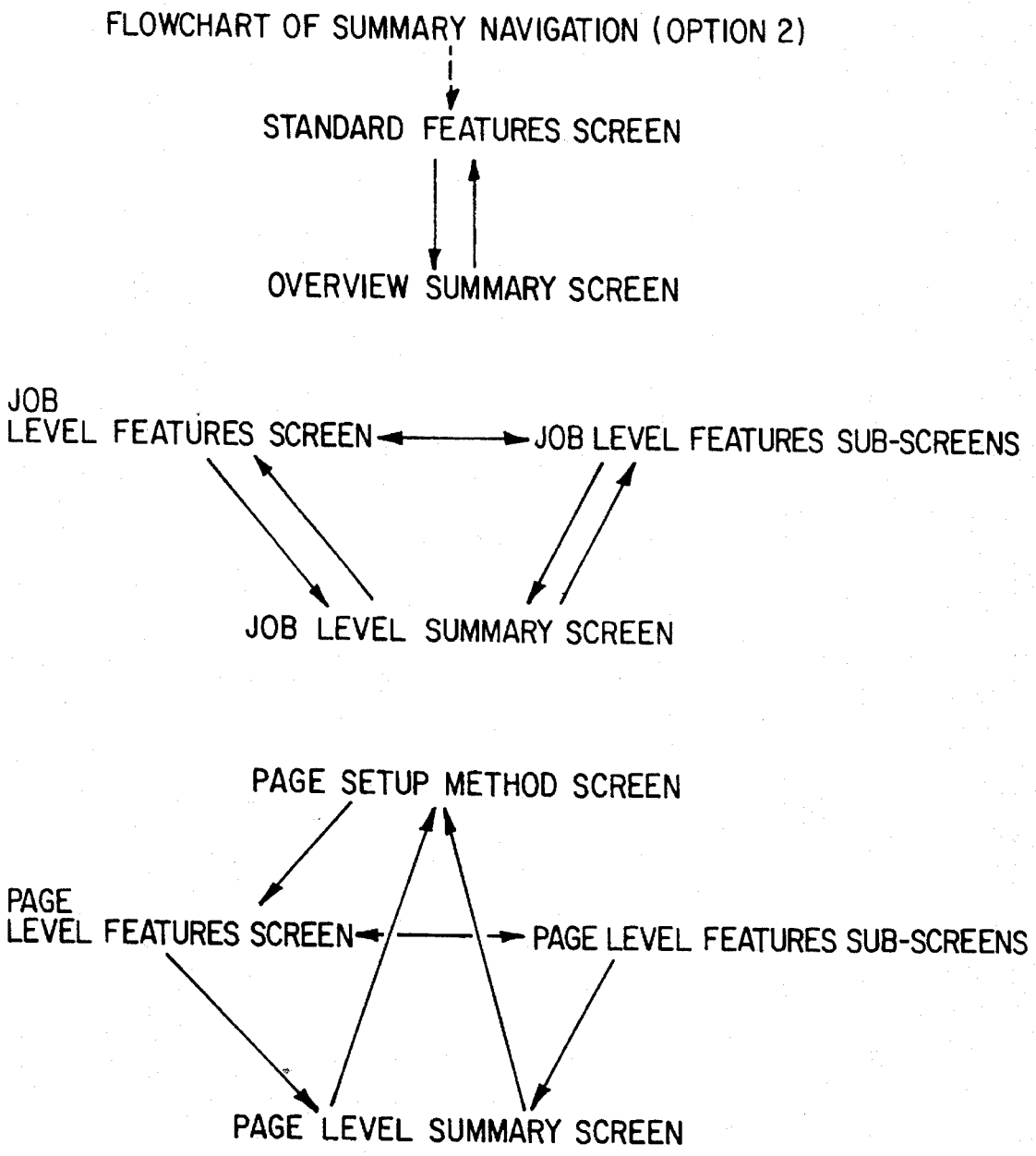
Figure 32:
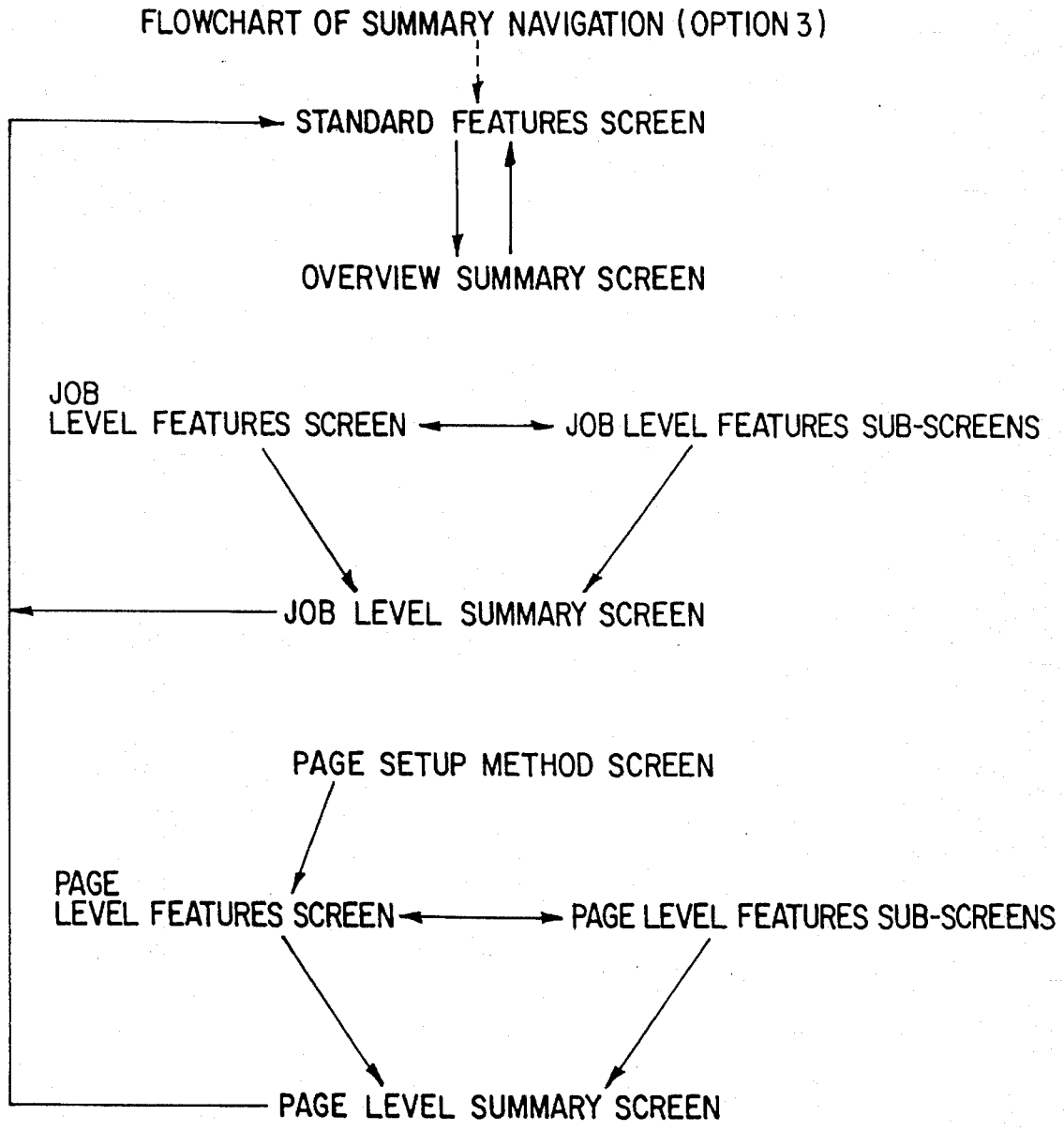
Figure 33:
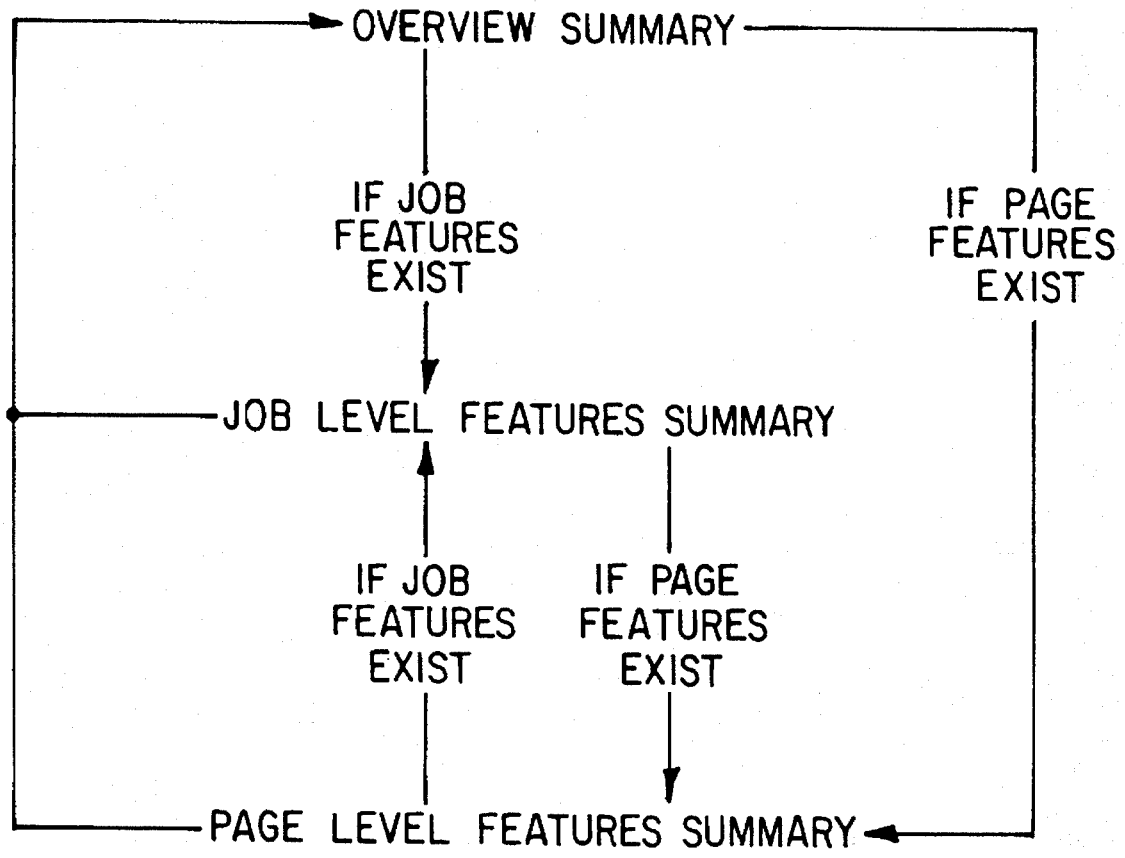
FIG. 33 shows one preferred inter-summary navigation flowchart according to the present invention.

Referring again to the examine navigation diagram shown in FIG. 24, it will be appreciated that for saved jobs, the user can operate the examine function to move directly between screens such as FIG. 27 (overview), FIG. 28 (job level features) and FIG. 29 (page level features), when such features are defined. That such features are defined, is indicated again by the highlighting of the appropriate touch region (i.e., overview, job features or page features) on the current screen. It will also be appreciated that such direct access between summarization screens of a saved job in the examine mode is analogous to the access between summarization screens FIG. 7, FIG. 15 and FIG. 20 of a current job in the summary mode. Thus, the term summarization is used herein to refer to compendium information on both the examine (saved job) and summary (current job) screens.

FIGS. 30–33 are flow charts illustrating several different ways that can be provided for exiting from summary systems in accord with the present invention. Each of the exiting paths illustrated offers it own unique advantages which will be clear to those skilled in the art; and other paths can be devised to function in accord with the invention. Similar exit paths can be provided for the examine navigation systems for stored jobs.

The invention has been described in detail with particular reference to preferred embodiments, but it will be understood that variations and modifications can be effected within the spirit and scope of the invention as set forth in the claims.

We claim:

1. Reproduction apparatus having a plurality of operating features for producing copy jobs, said apparatus comprising:

(i) an operator control communication interface including display means for producing a plurality of display screens having operating feature selections and means for producing signals representative of operating feature selections on such screens;

(ii) memory and control means for generating and addressing such screens onto such display means, for receiving and storing such selections signals and for controlling said apparatus to produce a copy job in accord with such selections signals;

(iii) summary means, operatively associated with said memory and control means, for generating and addressing said display means with separate display screens summarizing respectively, selected standard operating features, selected job level operating features and selected page level operating features.

2. The invention defined in claim 1 wherein the screens generated by said summary means comprise selected operating features lists, without display of non-selected features.

3. The invention defined in claim 1 further comprising a display navigation system, operatively associated with said memory and control and said summary means, for accessing display of different level summary displays directly from the feature selection process at the same level.

4. The invention defined in claim 3 wherein said navigation system enables access to a job level selections summary, directly from a job level feature selection screen.

5. The invention defined in claim 4 wherein said navigation system accesses an overview summary screen if an operator summary request occurs from a job level features selections screen, with no job level features having been selected.

6. The invention defined in claim 5 wherein said overview summary screen comprises a listing of standard level features selections and an abbreviated listing of job and page level features selections.

7. The invention defined in claim 3 wherein said navigation system enables access to a page level selections summary directly from a page level feature selections screen.

8. The invention defined in claim 7 wherein said navigation system accesses an overview summary screen if an operator summary request occurs from a page level features selections screen, with no page levels having been selected.

9. The invention defined in claim 8 wherein said overview summary screen comprises a listing of standard features selections and an abbreviated listing of job and page level features.

10. In a reproduction apparatus having a plurality of operating features, a display device for producing screens listing such features for job selection, means for generating signals representing selected features and memory and control means for storing such signals and controlling said apparatus in accord therewith to produce copy jobs, the method for summarizing user selected operating features, comprising the steps of:

(i) displaying an overview summarization screen comprising the standard operating features selected for a job, without non-selected standard operating features; and (ii) displaying a job level summarization screen comprising the job level operating features selected for a job, without non-selected job level operating features.

11. The method defined in claim 10 further comprising:

(i) displaying a page level summarization screen comprising the page level operating features selected for a job, without non-selected page level operating features.

12. The method defined in claim 11 wherein said overview summarization screen displaying includes display of an abbreviated list of the job level and page level operating features selected for the job.

13. The method defined in claim 10 wherein display of said overview summarization screen is accessed directly, in response to a summary request, during operator selection of standard level operating features.

14. The method defined in claim 10 wherein display of said job level summarization screen is accessed directly, in response to a summary request, during operator selection of job level operating features.

15. The method defined in claim 11 wherein display of said page level summarization screen is accessed directly, in response to a summary request, during operator selection of job level operating features.

16. The method defined in claim 15 wherein said overview summary screen is accessed in response to a summarization request during page or job level selections, if no respective operating features are then selected.

17. Reproduction apparatus having a plurality of operating features for producing copy jobs, said apparatus comprising:

(i) an operator control communication interface including display means for producing a plurality of display screens having operating feature selections;

(ii) memory and control means for generating and addressing such screens onto said display means, for receiving and storing selections signals and for controlling said apparatus to produce a copy job in accord with such selections signals:

(iii) compendium means, operatively associated with said memory and control means, for generating and addressing said display means with separate display screens respectively including summarizations of selected standard operating features, selected job level operating features and selected page level operating features.

18. The invention defined in claim 17 wherein the screens generated by said compendium means comprise selected operating features lists, without display of non-selected features.

19. The invention defined in claim 17 further comprising a display navigation system, operatively associated with said memory and control and said compendium means, for accessing display of different level summarization displays, directly from the feature selection process at the same level.

20. Reproduction apparatus having a plurality of operating features for producing copy jobs, said apparatus comprising:

(i) an operator control communication interface, including display means, for producing a plurality of display screens having operating feature selections;

(ii) memory and control mean for storing signals representative of the operating features selected for a copy job and controlling said apparatus to effect a copy job according to such stored signals;

(iii) compendium means, operatively associated with said memory and control means, for generating and addressing said display means with a plurality of display screens respectively including different selected operating feature summarizations.

21. The invention defined in claim 20 wherein said plurality of screens comprise selected operating features lists, without display of non-selected features.

* * * * *